US009290029B1

(12) United States Patent
Lee

(10) Patent No.: US 9,290,029 B1
(45) Date of Patent: Mar. 22, 2016

(54) INKJET PRINT APPARATUS AND INKJET PRINT METHOD

(71) Applicant: Samsung Display Co., Ltd., Yongin, Gyeonggi-Do (KR)

(72) Inventor: Tae Ho Lee, Seoul (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/710,792

(22) Filed: May 13, 2015

(30) Foreign Application Priority Data

Nov. 20, 2014 (KR) ..... 10-2014-0162840

(51) Int. Cl.
*B41J 29/393* (2006.01)

(52) U.S. Cl.
CPC ..... *B41J 29/393* (2013.01)

(58) Field of Classification Search
CPC .. B41J 29/393; B41J 2/17513; B41J 2/17523; B41J 2/1752; B41J 2/17556; B41J 2/04501
See application file for complete search history.

(56) References Cited

U.S. PATENT DOCUMENTS 5,477,244 A * 12/1995 Shibata ..... B41J 2/01 29/890.1
6,618,078 B1 9/2003 Budrys
2002/0171715 A1 11/2002 Takahagi et al.
2003/0085965 A1 5/2003 Yamada et al.
2005/0012782 A1 1/2005 Yoshimura et al.
2006/0164446 A1 7/2006 Beak
2009/0278874 A1 11/2009 Motoyama et al.
2012/0313995 A1 12/2012 Jimenez et al.
2013/0027452 A1 1/2013 Nakano et al.
2013/0029047 A1 1/2013 Nakano et al.

FOREIGN PATENT DOCUMENTS

JP 2005-181476 A 7/2005
JP 5332855 B2 8/2013
KR 1020060098304 A 9/2006

* cited by examiner

*Primary Examiner* — Juanita D Jackson
(74) *Attorney, Agent, or Firm* — Robert E. Bushnell, Esq.

(57) ABSTRACT

Provided are an inkjet print apparatus and an inkjet print method to reduce a process time required for replacing a head module. The inkjet print apparatus includes a first chamber having a head module; a second chamber disposed to contact the first chamber; and a third chamber disposed outside the first chamber and the second chamber and providing a space for performing a test for checking a state of a replacement head module. The method includes placing a first substrate in a first chamber below a head module; vertically moving the head module into the second chamber from the internal space of the first chamber when the head module is replaced with a replacement head module; and performing a test for checking a state of the replacement head module in a third chamber disposed outside the first chamber and the second chamber.

20 Claims, 22 Drawing Sheets

INKJET PRINT APPARATUS AND INKJET PRINT METHOD

CLAIM OF PRIORITY

This application makes reference to, incorporates the same herein, and claims all benefits accruing under 35 U.S.C. §119 from an application earlier filed in the Korean Intellectual Property Office on 20 Nov. 2014 and there duly assigned Serial No. 10-2014-0162840.

BACKGROUND OF THE INVENTION

1. Field of the Invention

The present invention relates to an inkjet print apparatus and an inkjet print method, and more specifically, to an inkjet print apparatus and an inkjet print method that can reduce the total process time of an ink ejection process.

2. Description of the Related Art

An organic light emitting display device among display devices as a self-luminous display element has advantages that a viewing angle is wide, contrast is excellent, and a response speed is high. Therefore, the organic light emitting display device has attracted pubic attention as a next generation display device.

The organic light emitting display device includes an organic light emitting layer made of an organic light emitting material between an anode electrode and a cathode electrode on a substrate. As positive voltage and negative voltage are applied to the electrodes, respectively, holes injected from the anode electrode move to the organic light emitting layer via a hole injection layer and a hole transport layer and electrons move to the organic light emitting layer via the electron injection layer and the electron transport layer from the cathode electrode, and as a result, the electrons and holes are recoupled with each other on the organic light emitting layer. Exciton is generated by the recoupling, and as the exciton is changed from an excited state to a ground state, the organic light emitting layer emits light to display an image.

The organic light emitting display includes a pixel defined layer having an opening formed for each pixel so as to expose the anode electrode formed for each pixel, and the organic light emitting layer is formed on the anode electrode exposed through the opening of the pixel defined layer. The organic light emitting layer may be formed by an inkjet print method using an inkjet print apparatus.

It is to be understood that this background of the invention is intended to provide useful background for understanding the technology and as such disclosed herein, the background section may include ideas, concepts or recognitions that were not part of what was known or appreciated by those skilled in the pertinent art prior to a corresponding effective filing date of subject matter disclosed herein.

SUMMARY OF THE INVENTION

An inkjet printing apparatus generally includes a chamber, a stage on which a substrate is seated, which is disposed in an internal space of the chamber, and a head disposed above the stage and ejecting ink onto the substrate.

Meanwhile, when clogging of a nozzle included in the head during an ink ejection process of ejecting the ink onto the substrate by using the head in the internal space of the chamber, inferior ejection of the ink ejected from the head, and the like occur, a process in which the head is replaced with a replacement head which is another head is performed and thereafter, the ink ejection process is performed again. In this case, before the inject ejection process is performed again, a process of checking a state of the replacement head in the internal space of the chamber is performed. For example, the process of checking the state of the replacement head may be a process of checking whether the replacement head meets an ink ejection condition for starting the ink ejection process. The ink ejection condition may be checked by driving the replacement head after charging the ink in the replacement head and for example, a condition regarding whether the ink is ejected onto a substrate for a test from the replacement head, whether an ejection amount of the ink ejected onto the substrate for the test from the replacement head is the same as a reference ejection amount for a predetermined time, or the like.

However, when inferiority of the replacement head is detected in the process of checking the state of the replacement head in the internal space of the chamber before the ink ejection process is performed again, the replacement head needs to be replaced with another replacement head. In this case, since a process of switching an atmosphere of the chamber in order to replace the replacement head with another replacement head, a process of moving the replacement head and another replacement head, a process of charging the ink in another replacement head, and a process of checking another replacement head need to be performed, a total process time of the ink ejection process using the inkjet print apparatus may be increased.

Therefore, the present invention has been made in an effort to provide an inkjet print apparatus that can reduce a total process time of an ink ejection process by reducing a process time required for replacing a head.

The present invention has also been made in an effort to provide an inkjet print method that can reduce the total process time of the ink ejection process by reducing the process time required for replacing the head.

The objects of the present invention are not limited to the aforementioned technical objects, and other technical objects, which are not mentioned above, will be apparent to those skilled in the art from the following description.

An aspect of the present invention provides an inkjet print apparatus including: a first chamber; a second chamber disposed to contact one side of the top of the first chamber; a stage disposed in an internal space of the first chamber and on which a first substrate is seated; a stage driver disposed below the stage in the internal space of the first chamber and configured to horizontally move the stage in the internal space of the first chamber; a head module configured to eject ink to the first substrate seated on the stage; a head driver disposed in an internal space of the second chamber and configured to vertically move the head module between the internal space of the first chamber and the internal space of the second chamber; and a third chamber disposed outside the first chamber and the second chamber and providing a space for performing a test for checking a state of a replacement head module including a head ejecting ink to a second substrate seated on the stage.

The replacement head module may be configured similar to the head module and vertically move between the internal space of the first chamber and the internal space of the second chamber by the head driver.

The inkjet print apparatus may further include a tester disposed in the internal space of or outside the third chamber and performing the test for checking the state of the replacement head module and the tester may include an electric signal line connected to the head, an ink supply pipe connected to the head, a camera photographing ink ejected to a test substrate from the head of the replacement head module, and a test controller receiving photographed data from the camera.

The first chamber may include a first bottom wall, a first top wall facing the first bottom wall and having an first opening that forms a passage in which the head module vertically moves, first side walls connecting the first bottom wall and the first top wall, and a first gate installed on the first top wall and actuated to open and close the first opening.

The head module may include a plurality of heads including nozzles ejecting the ink and a case including a body part covering the tops and the sides of the plurality of heads and a wing part that protrudes on the outer periphery of the body part.

The wing part may extend on the top wall of the first chamber at the lower side of the internal space of the second chamber and the width of a part of the case at which the wing part is positioned may be larger than that of the first opening.

The second chamber may include a second top wall facing the first top wall, second side walls connecting a part on the first top wall, which includes the first opening and the second top wall and having a second opening that forms a passage through which the head module or the replacement head module passes on any one thereof, and a second gate installed on any one of the second side walls and actuated to open and close the second opening.

The head driver may include a motor installed on another of the second side walls, a ball bearing connected to the motor, and a plate coupled with the head module and vertically moving in connection with the ball bearing.

The third chamber may include a third bottom wall, a third top wall facing the third bottom wall, third side walls connecting the third bottom wall and the third top wall and having a third opening that forms the passage through which the replacement head module passes, and a third gate actuated to open and close the third opening.

The stage driver may include a first linear motor supporting the stage and moving the stage in a first direction, a second linear motor disposed below the first linear motor and moving the stage in a second direction vertical to the first direction, a first air bearing disposed on the bottom wall of the first chamber, and a second air bearing disposed on the side walls of the first chamber.

The inkjet print apparatus may further include: a fourth chamber disposed to contact the other side of the top of the first chamber; and a replacement head driver disposed in an internal space of the fourth chamber and configured to vertically move the replacement head module between the internal space of the first chamber and the internal space of the second chamber.

A sub opening forming the passage in which the replacement head module vertically moves may be further formed on the first top wall of the first chamber and the first chamber may include a sub gate installed on the first top wall and actuated to open and close the sub opening, and the fourth chamber may include a fourth top wall facing the first top wall, fourth side walls connecting a part on the fourth top wall, which includes the sub opening and the fourth top wall and having a fourth opening forming the passage through which the replacement head module passes on any one thereof, and a fourth gate installed on any one of the fourth side walls and actuated to operate and close the fourth opening.

The replacement head driver may include a motor installed on another of the fourth side walls, a ball bearing connected to the motor, and a plate coupled with the replacement head module and vertically moving in connection with the ball bearing.

Another aspect of the present invention provides an inkjet print method comprising steps of: placing a first substrate seated on a stage in an internal space of a first chamber below a head module that vertically moves between an internal space of a second chamber disposed to contact the top of the first chamber and the internal space of the first chamber; ejecting ink to the first substrate from a plurality of heads of the head module by horizontally moving the stage while fixing the head module to the first chamber; vertically moving the head module to the internal space of the second chamber from the internal space of the first chamber at the time of replacing the head module with a replacement head module; and performing a test for checking a state of the replacement head module in a third chamber disposed outside the first chamber and the second chamber.

The inkjet print method may further comprise discharging the head module to the exterior of the second chamber after the vertically moving of the head module and making the replacement head module lead in the internal space of the second chamber to vertically move the replacement head module to the internal space of the first chamber from the internal space of the second chamber.

In the vertically moving of the head module, the internal space of the first chamber and the internal space of the second chamber may have the same atmosphere.

The inkjet print method may further comprise discharging the replacement head module from the third chamber and vertically moving the replacement head module to the internal space of the first chamber from an internal space of a fourth chamber disposed to contact the top of the first chamber.

After the vertically moving of the head module, the replacement head module may be fixed to the internal space of the first chamber when the head module is discharged to the exterior of the second chamber.

In the vertically moving of the replacement head module, the internal space of the fourth chamber and the internal space of the first chamber may have the same atmosphere.

The test of the replacement head module may be a test for determining whether the replacement head module is a head module that meets an ink ejection condition, and the ink ejection condition may include a condition in which ink is ejected from the head of the replacement head module and an ejection amount of the ink ejected from the head of the replacement head module is the same as a reference ejection amount for a predetermined time.

According to embodiments of the present invention, the following effects can be at least provided.

An inject print apparatus according to an embodiment of the present invention includes a third chamber disposed outside a first chamber and a second chamber, and providing a space for performing a test to check a state of a replacement head module to inspect the replacement head module in advance, which can be input into an internal space of the first chamber. Accordingly, a required time is reduced as a state of the replacement head module is tested while the replacement head module is input into the internal space of the first chamber when the existing head module is replaced with the replacement head module in the related art, and as a result, a total process time of an ink ejection process using an inkjet print apparatus can be reduced.

The ink jet apparatus according to the embodiment of the present invention includes a stage driver disposed below a stage in the internal space of the first chamber and configured to horizontally move the stage and a head driver disposed in an internal space of the second chamber positioned above the first chamber and configured to vertically move the head module to reduce generation of particles during an ink ejection process of ejecting ink to a substrate from a plurality of heads of the head module and minimize contamination of the internal space of the first chamber, which is caused due to particles which can be generated during a replacement process of replacing the head module.

The inkjet print apparatus according to the embodiment of the present invention includes a first gate installed in the first chamber and a second gate installed in the second chamber to replace the head module while maintaining an atmosphere of the internal space of the first chamber. Accordingly, the atmosphere of the internal space of the first chamber is undesirably changed, and as a result, a process time can be prevented from being increased as the atmosphere of the internal space of the first chamber is again set to a predetermined atmosphere to prevent the process time from being increased.

The technical objects of the present invention are not limited to the aforementioned technical objects, and other technical objects, which are not mentioned above, will be apparent to those skilled in the art from the following description.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Figure 1:
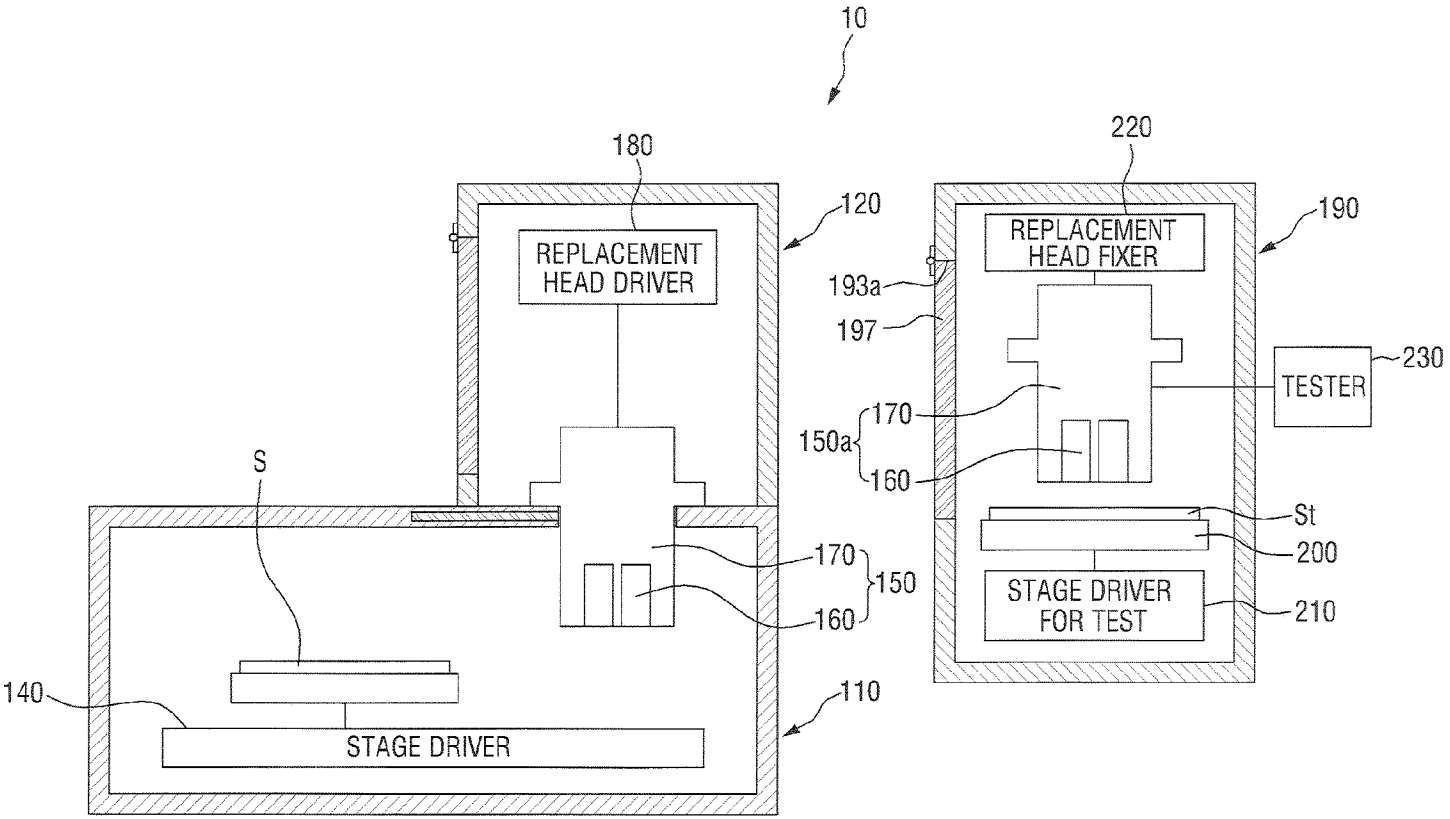
FIG. 1 is a schematic view of an inkjet print apparatus according to an embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include mean to targets in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, embodiments of the present invention will be described with reference to the accompanying drawings.

Figure 2:
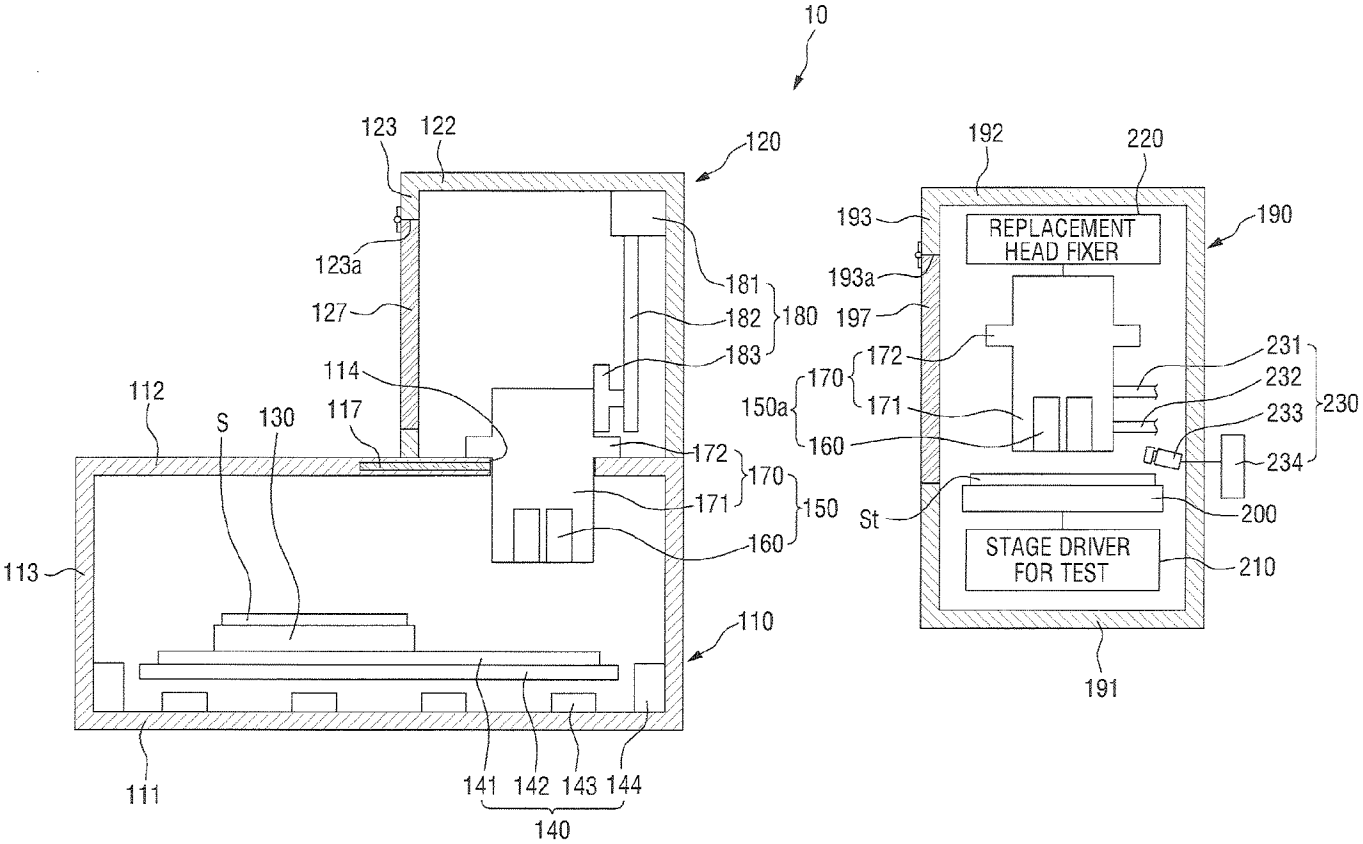
FIG. 2 is a schematic view illustrating, in detail, the inkjet print apparatus of FIG. 1.
Figure 3:
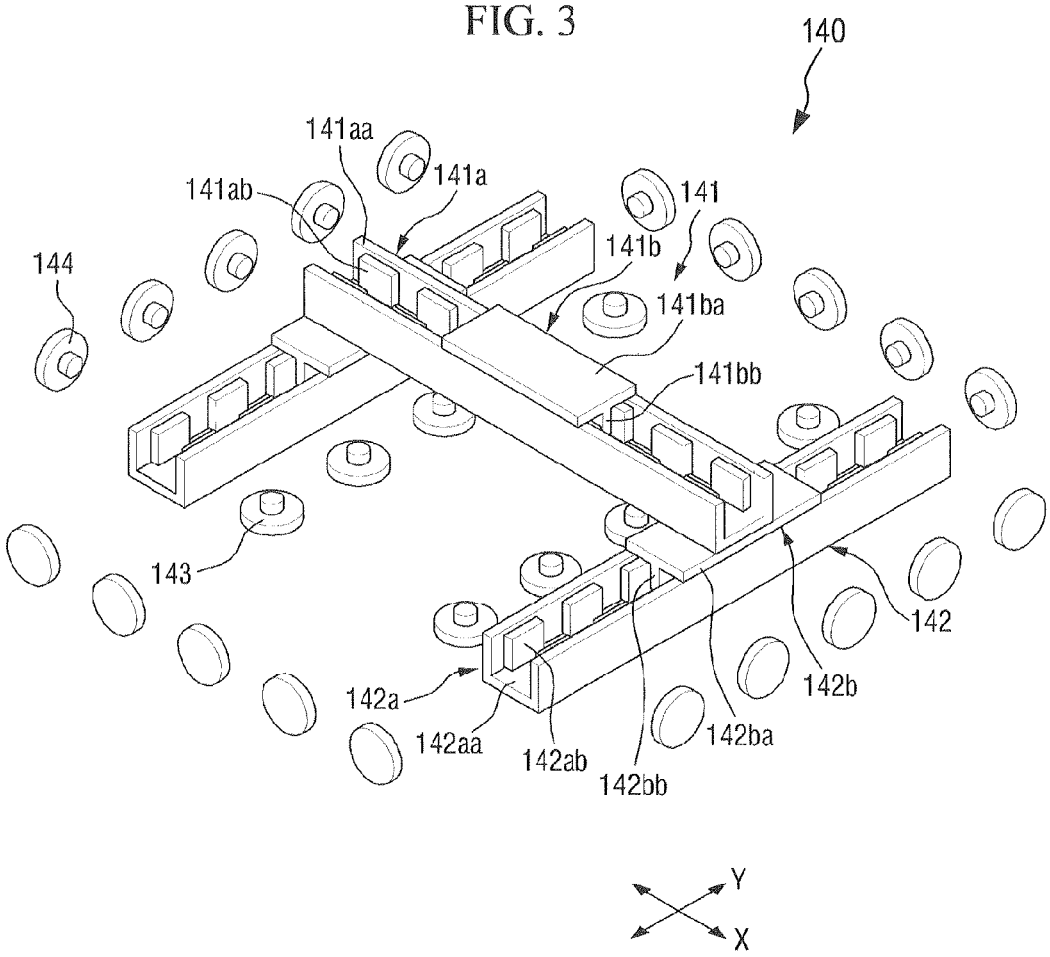
FIG. 3 is a perspective view illustrating a detailed configuration of a stage driver of FIG. 2.
Figure 4:
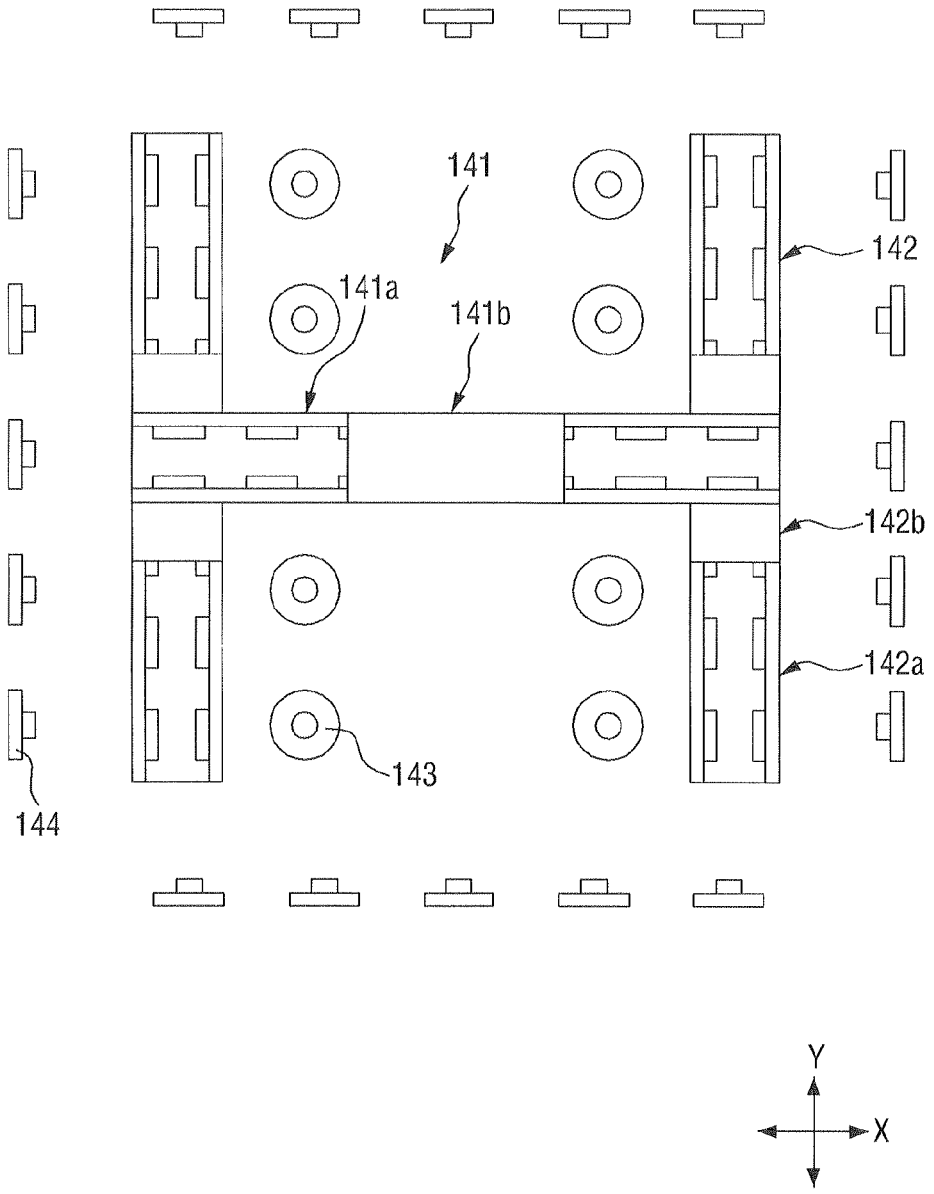
FIG. 4 is a plan view of the stage driver of FIG. 3.
Figure 5:
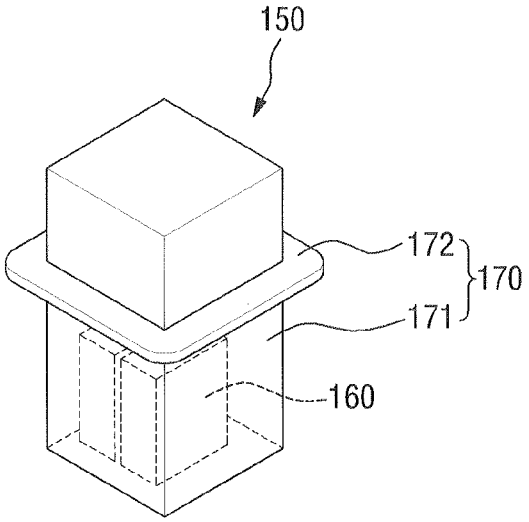
FIG. 5 is a perspective view of a head module of FIG. 2.

FIG. 1 is a schematic view of an inkjet print apparatus according to an embodiment of the present invention. FIG. 2 is a schematic view illustrating, in detail, the inkjet print apparatus of FIG. 1. FIG. 3 is a perspective view illustrating a detailed configuration of a stage driver of FIG. 2. FIG. 4 is a plan view of the stage driver of FIG. 3. FIG. 5 is a perspective view of a head module of FIG. 2.

In reference to FIGS. 1 and 2, the inkjet print apparatus 10 according to the embodiment of the present invention includes a first chamber 110, a second chamber 120, a stage 130, a stage driver 140, a head module 150, a head driver 180, a third chamber 190, a test stage 200, a test stage driver 210, a replacement head module 150*a*, a replacement head fixer 220, and a tester 230. The inkjet print apparatus 10 may be used to form an organic light emitting layer on a substrate of a display device, for example, an organic light emitting display.

The first chamber 110 as a process chamber is formed to have an internal space in which an ink ejection process of ejecting ink to a first substrate S from a plurality of heads 160 of the head module 150 may be performed. That is, the first chamber 110 may include a first bottom wall 111, a first top wall 112 facing the first bottom wall 111, and first side walls 113 connecting the first bottom wall 111 and the first top wall 112. A first opening 114 may be formed at a partial region of the first top wall 112. The first opening 114 forms a passage in which each of the head module 150 and the replacement head module 150*a* vertically moves between an internal space of the first chamber 110 and an internal space of the second chamber 120 in order to replace the head module 150. The head module 150 may be replaced, for example, when a problem such as clogging of a nozzle of the head 160 or inferior ejection of the ink ejected from the head 160 occurs. The problem may be detected by an examiner (including, for example, an examination camera) (not illustrated) installed in an internal space of the first chamber 110.

The first chamber 110 may further include a first gate 117 that enables the first opening 114 to be opened and closed. The first gate 117 is actuated to open the first opening 114 in the ink ejection process to allow a lower portion of the head module 150 to pass through the first opening 114 and an upper portion of the head module 150 to be fixed with being extended onto the first top wall 112 at a lower side of the internal space of the second chamber 120. Further, the first gate 117 is actuated to open the first opening 114 in a replacement process of replacing the head module 150 with another head module, that is, the replacement head module 150*a* to allow the head module 150 to vertically move to the internal space of the second chamber 120 from the internal space of the first chamber 110 or the replacement head module 150*a* to vertically move to the internal space of the first chamber from the internal space of the second chamber 120 (see FIGS. 9 and 15). However, after the first gate 117 completes vertically moving the head module 150 to the internal space of the second chamber 120 from the internal space of the first chamber 110 or before vertically moving the replacement head module 150*a* to the internal space of the first chamber 110 from the internal space of the second chamber 120, the first gate 117 is actuated to close the first opening 114 (see FIGS. 10 and 14).

Although not illustrated, an exit may be formed at one side of the first chamber 110, which allows the first substrate S to lead into the internal space of the first chamber 110 or to be withdrawn from the internal space of the first chamber 110. Further, a gas supply pipe which enables inert gas such as nitrogen gas to be provided in order to make the internal space of the first chamber 110 with an inert gas atmosphere and a vent unit which enables air to be provided in order to make the internal space of the first chamber 110 with an air atmosphere may be formed at the other side of the first chamber 110. The inert gas atmosphere may prevent components disposed on the first substrate S from being oxidized during the ink ejection process. When the ink ejection process is completed, the internal space of the first chamber 110 may be in an air atmospheric state. The first substrate S may be a substrate on which a pattern layer is to be formed by an inkjet print method using the inkjet print apparatus, for example, a substrate for the organic light emitting display on which the organic light emitting layer is to be formed.

The second chamber 120 as a replacement chamber is disposed to contact the top of the first chamber 110 and formed to have an internal space for replacing the head module 150. That is, the second chamber 120 may include a second top wall 122 facing the first top wall 112 of the first chamber 110 and second side walls 123 connecting a portion on the first top wall 112 of the first chamber 110, which includes the first opening 114 and the second top wall 122. A second opening 123*a* may be formed at any one of the second side walls 123. The second opening 123*a* forms a passage in which each of the head module 150 and the replacement head module 150*a* may move in order to replace the head module 150 which moves to the internal space of the second chamber 120 from the internal space of the first chamber 110 with the replacement head module 150*a*. As a result, the head module 150 may move to the exterior of the second chamber 120 through the second opening 123*a* or the replacement head module 150*a* may move to the internal space of the second chamber 120 through the second opening 123*a*. Herein, the replacement head module 150*a* that moves to the internal space of the second chamber 120 may be a head module determined that there is no problem in performing the ink ejection process by a test for state checking in the third chamber 190.

The second chamber 120 may further include a second gate 127 that enables the second opening 123*a* to be opened and closed. The second gate 127 is actuated to open the second opening 127 to allow the head module 150 to move to the outside of the second chamber 120 and the replacement head module 150*a* to move to the internal space of the second chamber 120 in the replacement process (see FIGS. 11 and 13). Further, the second gate 127 may be actuated to close the second opening 127 after the replacement head module 150*a* moves to the internal space of the second chamber 120 (see FIG. 14).

Although not illustrated, a gas supply pipe which enables the inert gas such as the nitrogen gas to be provided in order to make the internal space of the second chamber 120 with the inert gas atmosphere and a vent unit which enables the air to be provided in order to make the internal space of the second chamber 120 with the air atmosphere may be formed at one side of the second chamber 120. The inert gas atmosphere or the air atmosphere of the internal space of the second chamber 120 may be selected to make the atmospheres of the internal spaces of the first and second chambers 110 and 120 similarly match each other when the head module 150 vertically moves between the internal space of the first chamber 110 and the internal space of the second chamber 120.

The stage 130 is disposed at a lower side of the internal space of the first chamber 110 and provides a space on which the first substrate S is seated. The stage 130 may be configured to fix the first substrate S by using vacuum absorption or electrostatic force, but is not limited thereto.

The stage driver 140 is disposed below the stage 130 in the internal space of the first chamber 110 and configured to horizontally move the stage 130. The stage driver 140 may include a first linear motor 141, a second linear motor 142, a first air bearing 143, and a second air bearing 144.

The first linear motor 141 is configured to support the stage 130 and move the stage 130 in a first direction X as illustrated in FIGS. 3 and 4. To this end, the first linear motor 141 may include a first fixer 141*a* and a first mover 141*b*. The first fixer 141*a* may include a receiving frame 141*aa* extended in the first direction X and magnets 141*ab* disposed on an inner surface of the receiving frame 141*aa* to be spaced apart at a predetermined interval. The first mover 141*b* may include a support frame 141*ba* supporting the stage 130 and a coil block 141*bb* in which a coil (not illustrated) is disposed on the bottom of the support frame 141*ba*.

The first linear motor 141 configured as above may move the support frame 141*ba* in the first direction X by using electromagnetic force of the magnet 141*ab* and the coil block 141*bb* by control with a controller (not illustrated). As a result, the stage 130 supported by the support frame 141*ba* and the first substrate S seated on the stage 130 may move in the first direction X.

The second linear motor 142 may be, in multiple, disposed below the first linear motor 141 and is configured to move the stage 130 in a second direction Y vertical to the first direction X. To this end, the second linear motor 142 may include a second fixer 142*a* and a second mover 142*b*. The second fixer 142*a* may include a receiving frame 142*aa* extended in the second direction Y and magnets 142*ab* disposed on an inner surface of the receiving frame 142*aa* to be spaced apart at a predetermined interval. The second mover 142*b* may include a support frame 142*ba* supporting the first linear motor 141 and a coil block 142*bb* in which a coil (not illustrated) is disposed on the bottom of the support frame 142*ba*.

The second linear motor 142 configured as above may move the support frame 142*ba* in the second direction Y by using electromagnetic force of the magnet 142*ab* and the coil block 142*bb* by the control with the controller (not illustrated). As a result, the first linear motor 141 supported by the support frame 142*ba*, the stage 130 supported by the first linear motor 141, and the first substrate S seated on the stage 130 may move in the second direction Y.

The first air bearing 143 is disposed on the first bottom wall 111 of the first chamber 110 and configured to eject air. The first air bearing 143 may reduce generation of particles due to contact of instruments when the first mover 141*b* moves by making the first mover 141*b* of the first linear motor 141 float while air is ejected.

The second air bearing 144 is disposed on the first side walls 113 of the first chamber 110 and configured to eject air. The second air bearing 144 may reduce generation of particles caused by contacting the second fixer 142*a* due to inclination of the second mover 142*b* in any one direction when the second mover 142*b* of the second linear motor 142 moves. Further, the second air bearing 144 may reduce generation of particles caused by contacting the first fixer 141*a* due to inclination of the first mover 141*b* in any one direction when the first mover 141*b* of the first linear motor 141 moves.

The first substrate S may horizontally move in the first direction X and the second direction Y by the first linear motor 141 and the second linear motor 142, and the generation of the particles may be reduced when the first substrate S moves horizontally by reducing contact among instruments of the stage driver 140 by the first air bearing 143 and the second air bearing 144 when the first substrate S moves horizontally.

The head module 150 is disposed while being fixed to the internal space of the first chamber 110 in the ink ejection process and is movable vertically between the internal space of the first chamber 110 and the internal space of the second chamber 120 in the replacement process. The head module 150 may include a plurality of heads 160 and a case 170.

The plurality of heads 160 as members that eject ink to the first substrate S seated on the stage 130 includes a nozzle (not illustrated) which is disposed in a lower portion thereof and ejects ink. Further, although not illustrated, an ink storage unit storing ink to be ejected may be installed in the head 160. An ink ejection operation of the head 160 may be performed by the control with the controller (not illustrated). The control with the controller may mean control such as viscosity of the ink and an ejection amount of the ink.

The case 170 is formed to cover the plurality of heads 160. As illustrated in FIG. 5, the case 170 may include a body part 171 covering the top and the side of the plurality of heads 160 and a wing part 172 that protrudes on an outer periphery of the body part 171. Herein, the width of a part in the case 170, at which the wing part 172 is positioned may be larger than that of the first opening 117. The top of the head module 150 may be fixed while being extended on the first top wall 112 in the ink ejection process through the case 170.

The head driver 180 is disposed in the internal space of the second chamber 120 and configured to vertically move the head module 150 between the internal space of the first chamber 110 and the internal space of the second chamber 120. The head driver 180 may include a motor 181 generating power, a ball bearing 182 connected to the motor 181 and rotated by the power of the motor 181, and a plate 183 coupled with the head module 150 and linearly moving by the rotation of the ball bearing 182 to vertically move the head module 150. Since the head driver 180 is disposed in the internal space of the second chamber 120, the contamination of the internal space of the first chamber 110, which is caused due to the particles generated by the contact of the instruments of the head driver 180 may be minimized when the head module 150 vertically moves in the replacement process.

The third chamber 190 as a test chamber is formed to have an internal space to test the replacement head module 150*a* in order to check a state of the replacement head module 150*a*. That is, the third chamber 190 may include a third bottom wall 191, a third top wall 192 facing the third bottom wall 191, and third side walls 193 connecting the third bottom wall 191 and the third top wall 192. A third opening 193*a* may be formed at any one of the third side walls 193. The third opening 193*a* forms a passage for moving the replacement head module 150*a* of which a test is completed to the second chamber 120 or moving another replacement head module of which the test is required to an internal space of the third chamber 190. The test of the replacement head module 150*a* may be testing whether the replacement head module 150*a* is a head module that meets an ink ejection condition. The ink ejection condition are conditions for starting the ink ejection process and may be checked by driving the head 160 after charging the ink in the head 160 included in the replacement head module 150*a*. The ink ejection condition may be a condition regarding whether ink is ejected to the test substrate St from the head 160, whether an ejection amount of the ink ejected to the test substrate St from the head 160 for a predetermined time is the same as a reference ejection amount, or the like.

The third chamber 190 provides a space to test and inspect the replacement head module 150*a* in advance, which may be input into the internal space of the first chamber 110. As a result, a required time is reduced as a state of the replacement head module is tested while the replacement head module is input into the internal space of the first chamber when the existing head module is replaced with the replacement head module in the related art, and as a result, a total process time of an ink ejection process using an inkjet print apparatus can be reduced.

The third chamber 190 may further include a third gate 197 that enables the third opening 193*a* to be opened and closed. The third gate 197 is actuated to open the third opening 193*a* after completing the test of the replacement head module 150*a* or before moving another replacement head module which needs to be tested to the internal space of the third chamber 190 to discharge the replacement head module 150*a* to the outside of the third chamber 190 (see FIG. 12) or move another replacement head module that needs to be tested to the internal space of the third chamber 190. However, the third gate 197 is actuated to close the third opening 193*a* after completing moving the replacement head module 150*a* to the outside from the internal space of the third chamber 190 (see FIG. 13) or after moving another replacement head module which needs to be tested to the internal space from the exterior of the third chamber 190.

Although not illustrated, an exit may be formed at one side of the third chamber 190, which allows the test substrate St for testing the replacement head module 150*a* to lead into the internal space of the third chamber 190 or to be withdrawn from the internal space of the third chamber 190. Further, a gas supply pipe which enables the inert gas such as the nitrogen gas to be provided in order to make the internal space of the third chamber 190 with the inert gas atmosphere and a vent unit which enables air to be provided in order to make the internal space of the third chamber 190 with the air atmosphere may be formed at the other side of the third chamber 190. The inert gas atmosphere may prevent components disposed on the test substrate St from being oxidized in an ink ejection test process of ejecting the ink to the test substrate St from the replacement head module 150*a* in order to test the replacement head module 150*a*. When the ink ejection test process is completed, the internal space of the third chamber 190 may be in the air atmospheric state. The test substrate St may be a substrate on which the pattern layer is to be formed by the inkjet print method using the inkjet print apparatus, for example, a substrate for the organic light emitting display on which the organic light emitting layer is to be formed.

The test stage 200 is disposed at a lower side of the internal space of the third chamber 190 and provides a space on which the test substrate St is seated. The test stage 200 may be configured to fix the test substrate St by using the vacuum absorption or electrostatic force, but is not limited thereto.

The test stage driver 210 is disposed below the test stage 200 in the internal space of the third chamber 190 and configured to horizontally move the test stage 200. As a result, the replacement head module 150*a* may be tested under the same environment as an environment in which the ink ejection process is performed in the first chamber 110. The test stage driver 210 has the same configuration as the components of the head driver 140.

The replacement head module 150*a* is a head module replacing the head module 150 when the problem such as clogging of the nozzle of the head 160 included in the head module 150 that performs the ink ejection process in the internal space of the first chamber 110 or the inferior ejection of the ink ejected from the head 160 occurs. Since the replacement head module 150*a* is configured similarly to the head module 150, the replacement head module 150*a* includes a plurality of heads 160, and the case 170 including the body part 171 and the wing part 172 similar to those of the head module 150.

The replacement head fixer 220 is disposed to be fixed to the third top wall 192 of the third chamber 190 and fixes the replacement head module 150*a* that leads in the internal space of the third chamber 190. The replacement head fixer 220 may be formed by a plate which is configured in such a manner that the replacement head module 150*a* is detachable and attachable.

The tester 230 is installed in the internal space of and outside the third chamber 190 and tests the replacement head module 150*a* in order to check the state of the replacement head module 150*a*. The tester 230 may include an electric signal line 231 connected to the head 160 of the replacement head module 150*a*, an ink supply pipe 232 connected to the head 160 of the replacement head module 150*a*, a camera 233 photographing the ink ejected to the test substrate St from the head 160 of the replacement head module 150*a*, and a test controller 234 receiving photographed data from the camera 233.

The electric signal line 231 is a transmission line of power and a drive signal for driving the head 160. The ink supply pipe 232 is a pipe that supplies ink required for verifying the ink ejection condition for starting the ink ejection process to the head 160. The camera 233 is a device for providing data for verifying whether the replacement head module 150*a* meets the ink ejection condition for starting the ink ejection process. The test controller 234 determines whether the replacement head module 150*a* meets the ink ejection condition for starting the ink ejection process based on the data photographed from the camera 233.

When the test controller 234 determines that the replacement head module 150*a* meets the ink ejection condition for starting the ink ejection process, the replacement head module 150*a* moves to the internal space of the first chamber 110 through the second chamber 120 to be used for performing the ink ejection process. On the contrary, when the test controller 234 determines that the replacement head module 150*a* does not meet the ink ejection condition for starting the ink ejection process, the replacement head module 150*a* is detached from the replacement head fixer 200 and discharged from the third chamber 190, and another replacement head module moves to the internal space of the third chamber 190 to perform a test for checking a state of another replacement head module. Although it is illustrated that the tester 230 includes the electric signal line 231, the ink supply pipe 232, the camera 233, and the test controller 234 in FIG. 2, but the tester 230 may include an ejection driver (not illustrated) that enables the head 160 to eject ink.

Meanwhile, although not illustrated, the aforementioned controller controls all processes using the inkjet print apparatus 10 in addition to controlling the stage driver 150 and controlling the head driver 180. For example, the controller controls even an ejection process of ejecting ink to the first substrate S from the head 60, a process of discharging and moving the head module 150 from the internal space of the second chamber 120, a process of moving the replacement head module 150*a* between the second chamber 120 and the third chamber 190, and the like. The controller may be implemented by a computer or a device similar thereto by using hardware, software, or a combination thereof.

The inkjet print apparatus 10 according to the embodiment of the present invention includes the third chamber 190 disposed outside the first chamber 110 and the second chamber 120 and providing the space for performing the test to check the state of the replacement head module 150*a* to inspect the replacement head module 150*a* in advance, which may be input into the internal space of the first chamber 110. Accordingly, a required time is reduced as a state of the replacement head module is tested while the replacement head module is input into the internal space of the first chamber when the existing head module is replaced with the replacement head module in the related art, and as a result, a total process time of an ink ejection process using an inkjet print apparatus can be reduced.

The inkjet print apparatus 10 includes the stage driver 140 disposed below the stage 130 in the internal space of the first chamber 110 and the head driver 180 disposed in the internal space of the second chamber 120 positioned above the first chamber 110 to eject ink to the substrate S from the plurality of heads 60 by horizontally moving the stage 130 while fixing the head module 150 in the ink ejection process and actuate the head driver 180 that vertically moves the head module 150 in the second chamber 120 at the time of replacing the head module 150. Accordingly, the head driver 180 is not actuated in the ink ejection process to prevent the particles from being generated by the contact of the instruments and the head driver 180 is actuated in the replacement process of the head module 150 to minimize contamination of the internal space of the first chamber 110 due to the particles which lead in the internal space of the first chamber 110 even though the particles are generated in the internal space of the second chamber 120 by the contact of the instruments.

The inkjet print apparatus 10 according to the embodiment of the present invention includes the first gate 117 installed in the first chamber 110 and the second gate 127 installed in the second chamber 120 to replace the head module 150 while maintaining the atmosphere of the internal space of the first chamber 110. Accordingly, the atmosphere of the internal space of the first chamber 110 is undesirably changed, and as a result, a process time can be prevented from being increased as the atmosphere of the internal space of the first chamber 110 is again set to a predetermined atmosphere to prevent the total process time of the ink ejection process from being increased.

Next, an inkjet print method using the inkjet print apparatus 10 according to the embodiment of the present invention will be described.

FIGS. 6 through 17 are diagrams for illustrating an inkjet print method using the inkjet print apparatus of FIG. 2.

Figure 6:
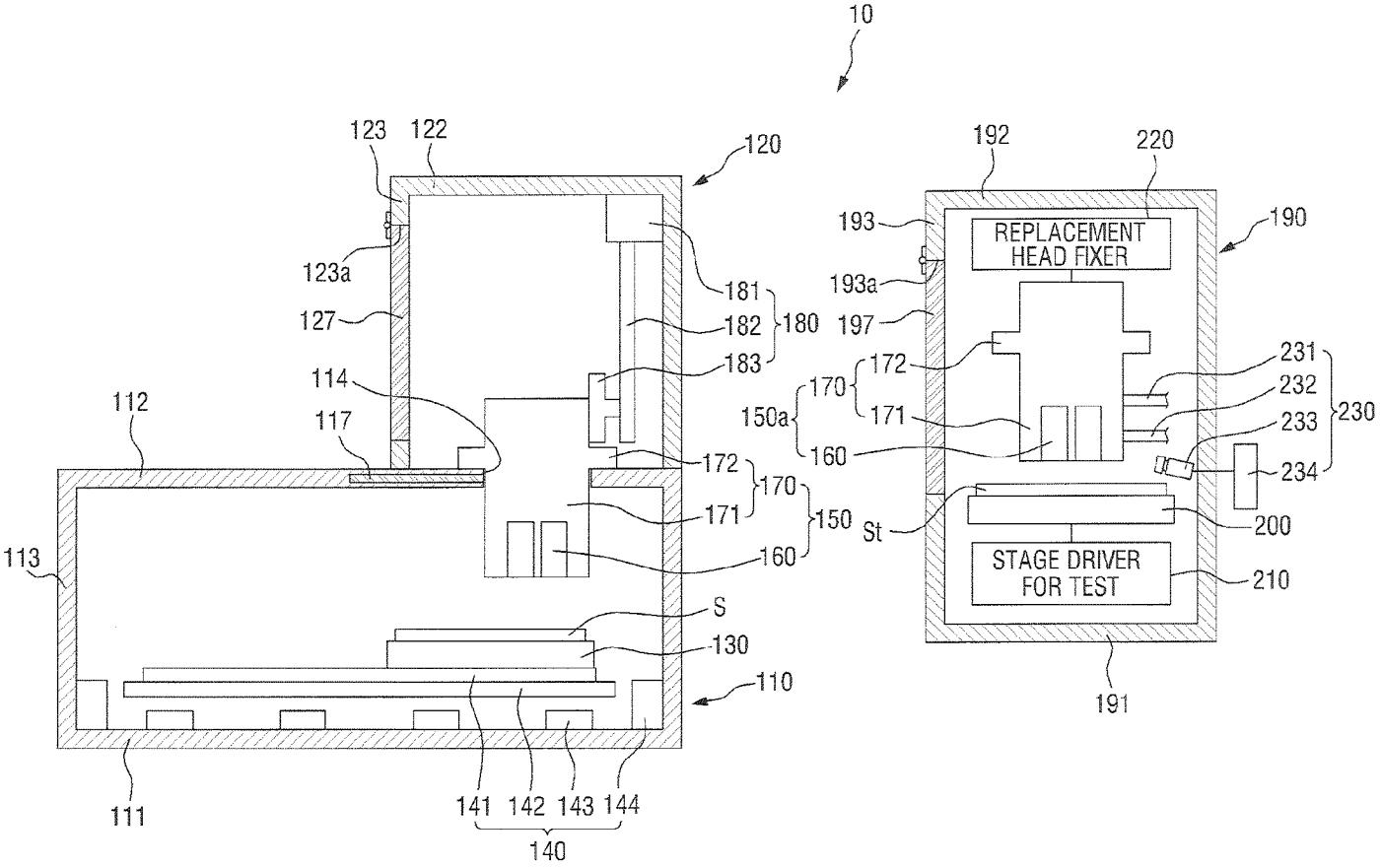
FIGS. 6 through 17 are diagrams for illustrating an inkjet print method using the inkjet print apparatus of FIG. 2.

In reference to FIG. 6, the first substrate S seated on the stage 130 disposed in the internal space of the first chamber 110 is disposed below the head module 150 disposed in the internal space of the first chamber 110. In this case, the internal space of the first chamber 110 may be the inert gas atmosphere charged with the inert gas. Herein, the head module 150 leads in the internal space of the first chamber 110 from the internal space of the second chamber 120 through the first opening 114 of the first chamber 110 to be disposed in the internal space of the first chamber 110 and while the wing part 172 of the head module 150 is extended onto the first top wall 112 of the first chamber 110 from the lower side of the internal space of the second chamber 120, the head module 150 is fixed.

Figure 7:
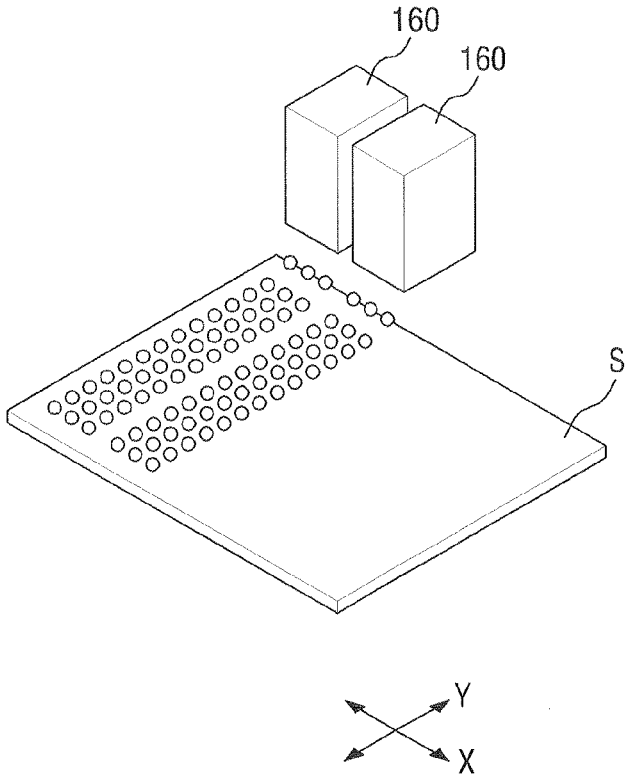
Figure 8:
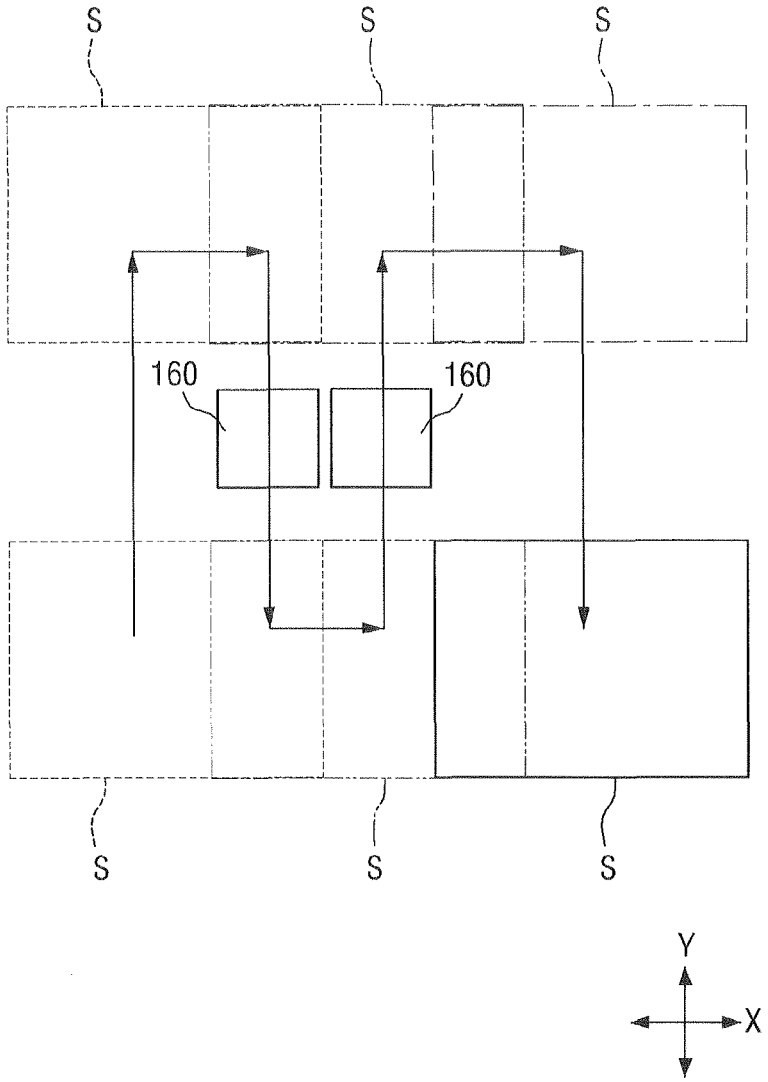

By horizontally moving the stage 130 in the first direction X and the second direction Y while the head module 150 is fixed, the ink is ejected to the first substrate S from the plurality of heads 160 as illustrated in FIG. 7 (ink ejection process). The horizontal movement of the first substrate S by the horizontal movement of the stage 130 is exemplarily illustrated in FIG. 8. Meanwhile, during the ink ejection process, the test for checking the state of the replacement head module 150*a* may be in progress or be completed in the third chamber 190. Since the test of the replacement head module 150*a* has been described above in detail, a duplicated description will be omitted.

Figure 9:
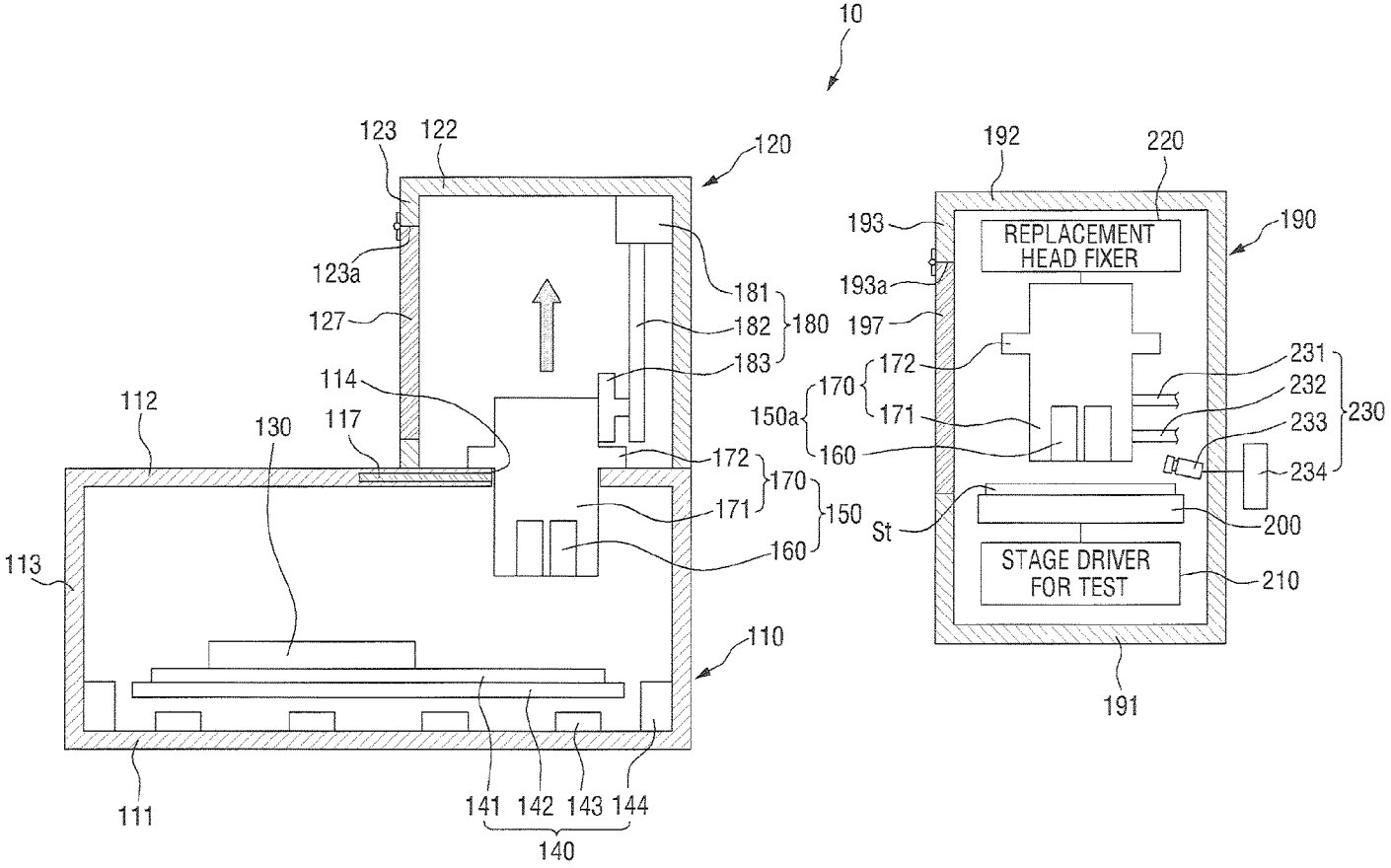

Subsequently, in reference to FIG. 9, when replacement of the head module 150 is required, the head module 150 vertically moves to the internal space of the second chamber 120 from the internal space of the first chamber 110. In this case, the internal space of the second chamber 120 may be in the inert gas atmosphere similarly to the internal space of the first chamber 110. Further, the first substrate S may be discharged from the first chamber 110. The head module 150 may vertically move by actuating the head driver 180.

Figure 10:
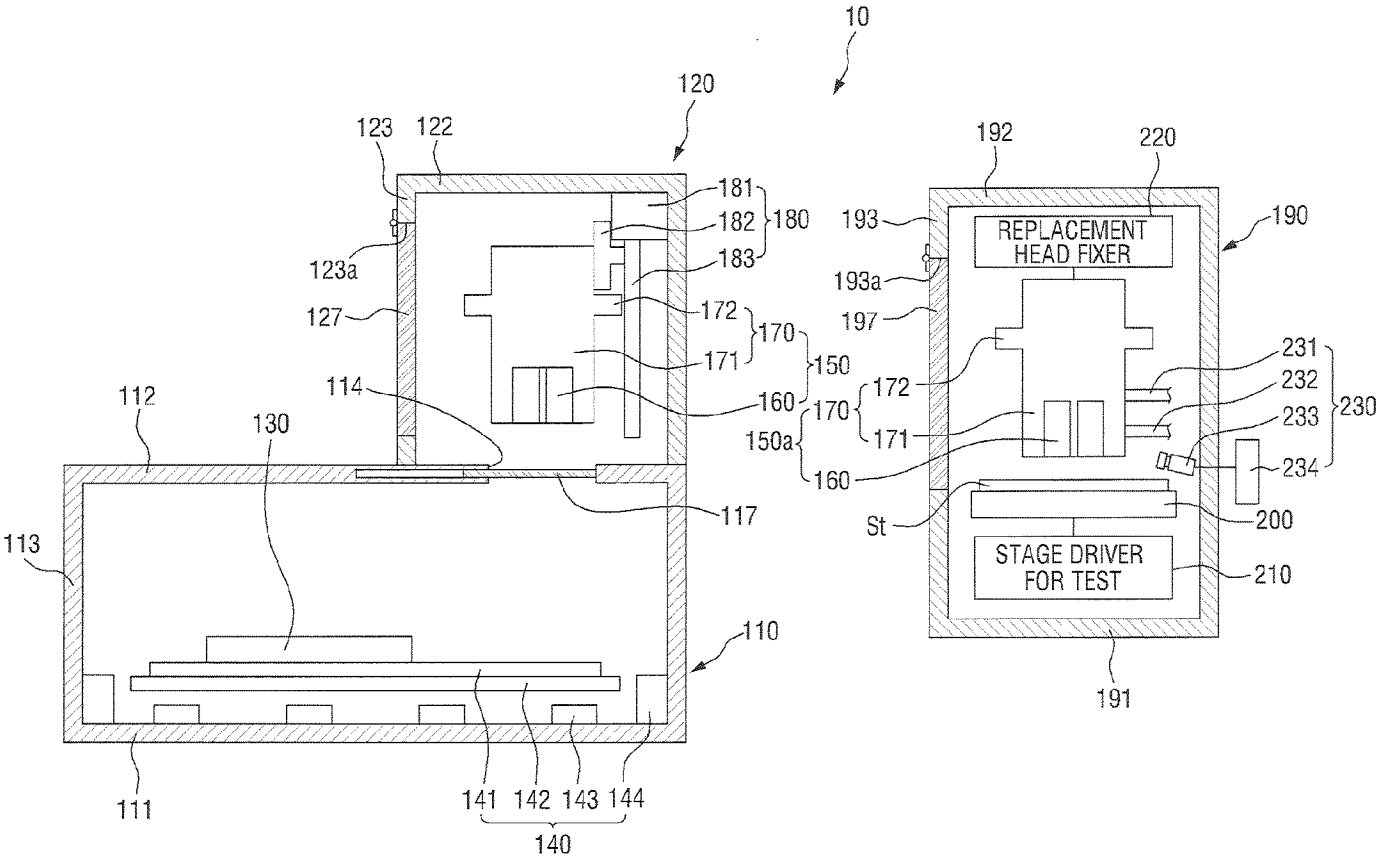

Subsequently, in reference to FIG. 10, the head module 150 is disposed in the internal space of the second chamber 120 and thereafter, actuates the first gate 117 to close the first opening 114. Thereafter, the internal space of the second chamber 120 is made to be in a stand-by state by using a vent unit (not illustrated).

Figure 11:
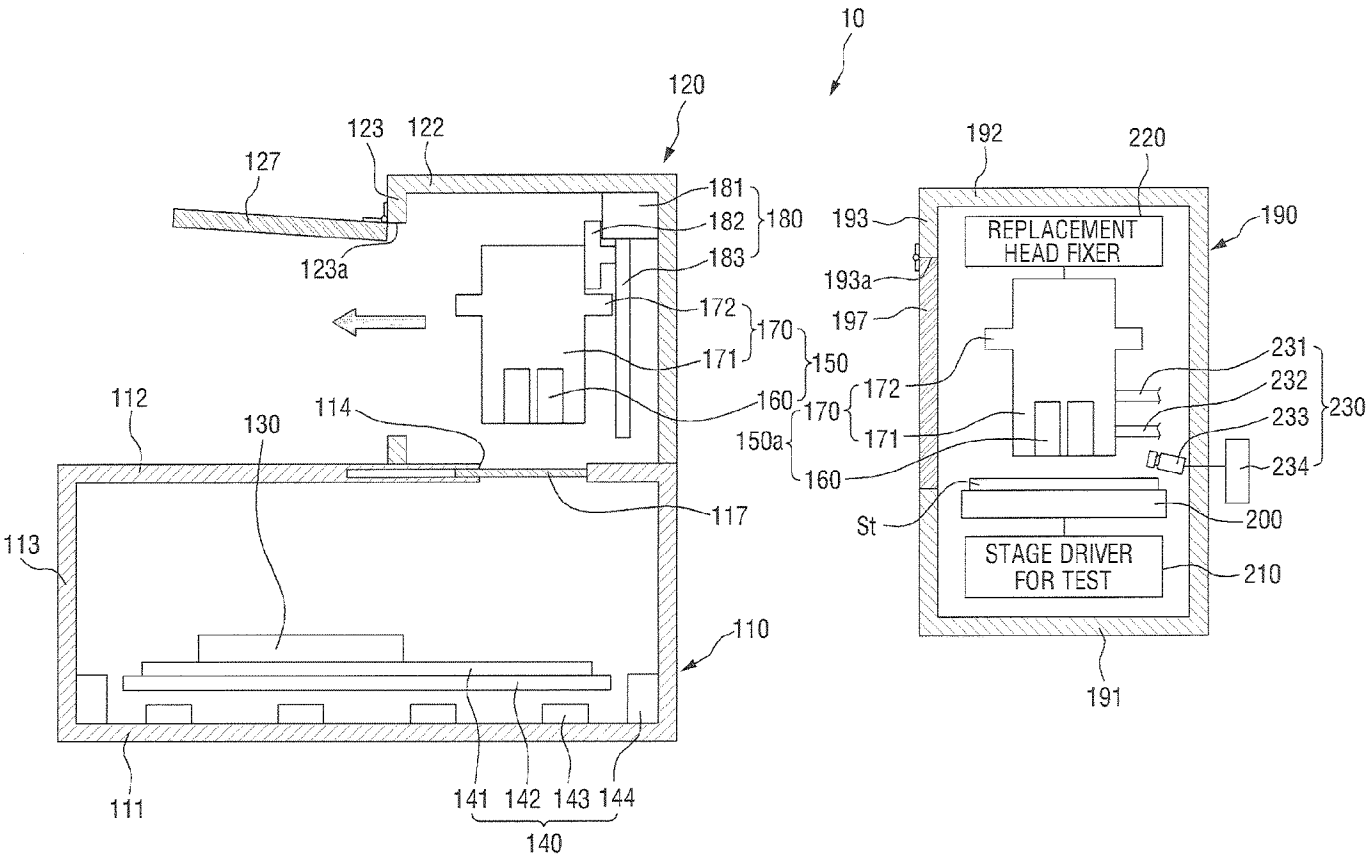

Subsequently, in reference to FIG. 11, the second gate 127 is actuated to open the second opening 123*a* and discharge the head module 150 from the second chamber 120. In this case, the head module 150 may be separated from the head driver 180 and thereafter, move. The head module 150 may be separated and moved by a robot or an operator.

Figure 12:
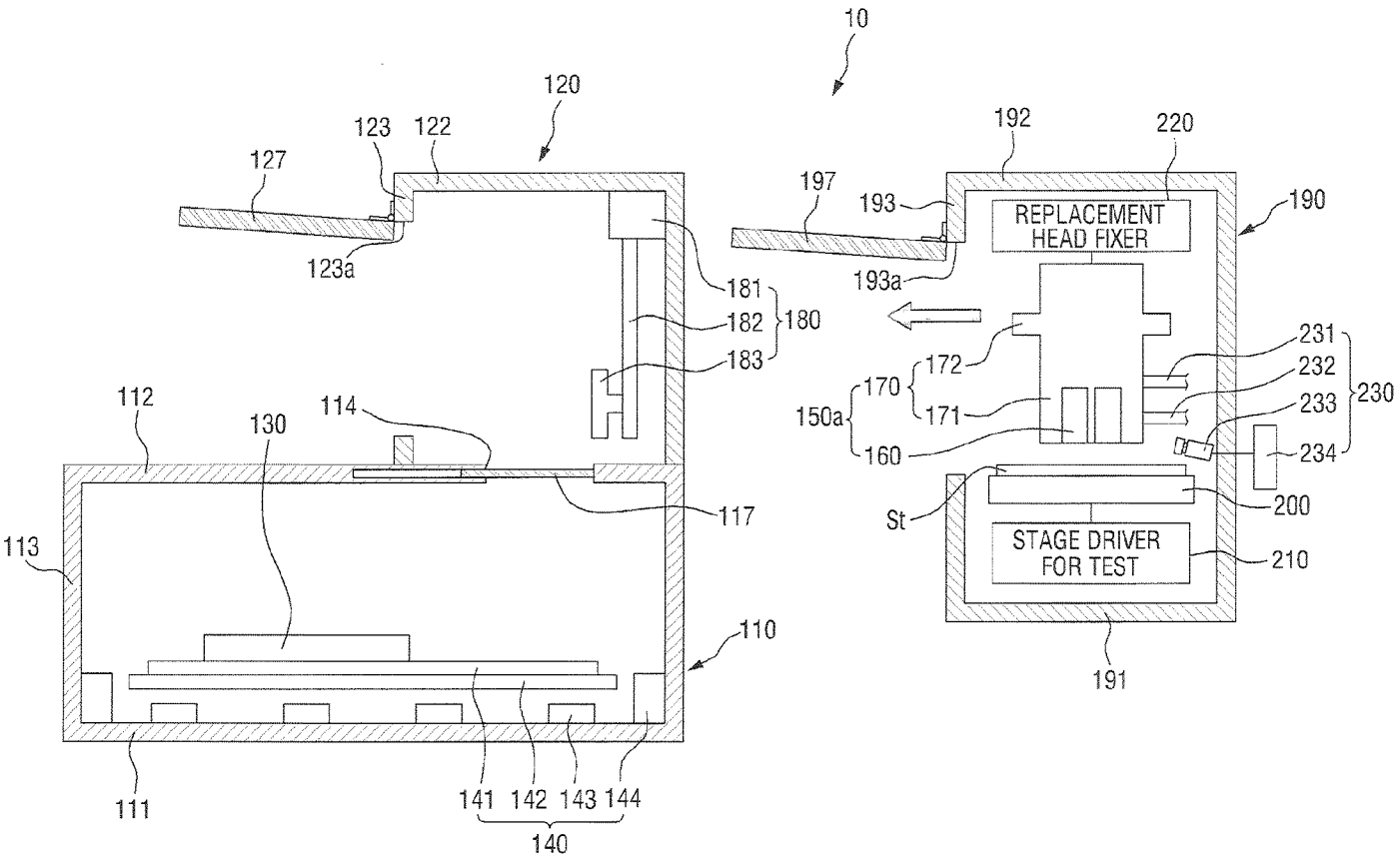
Figure 13:
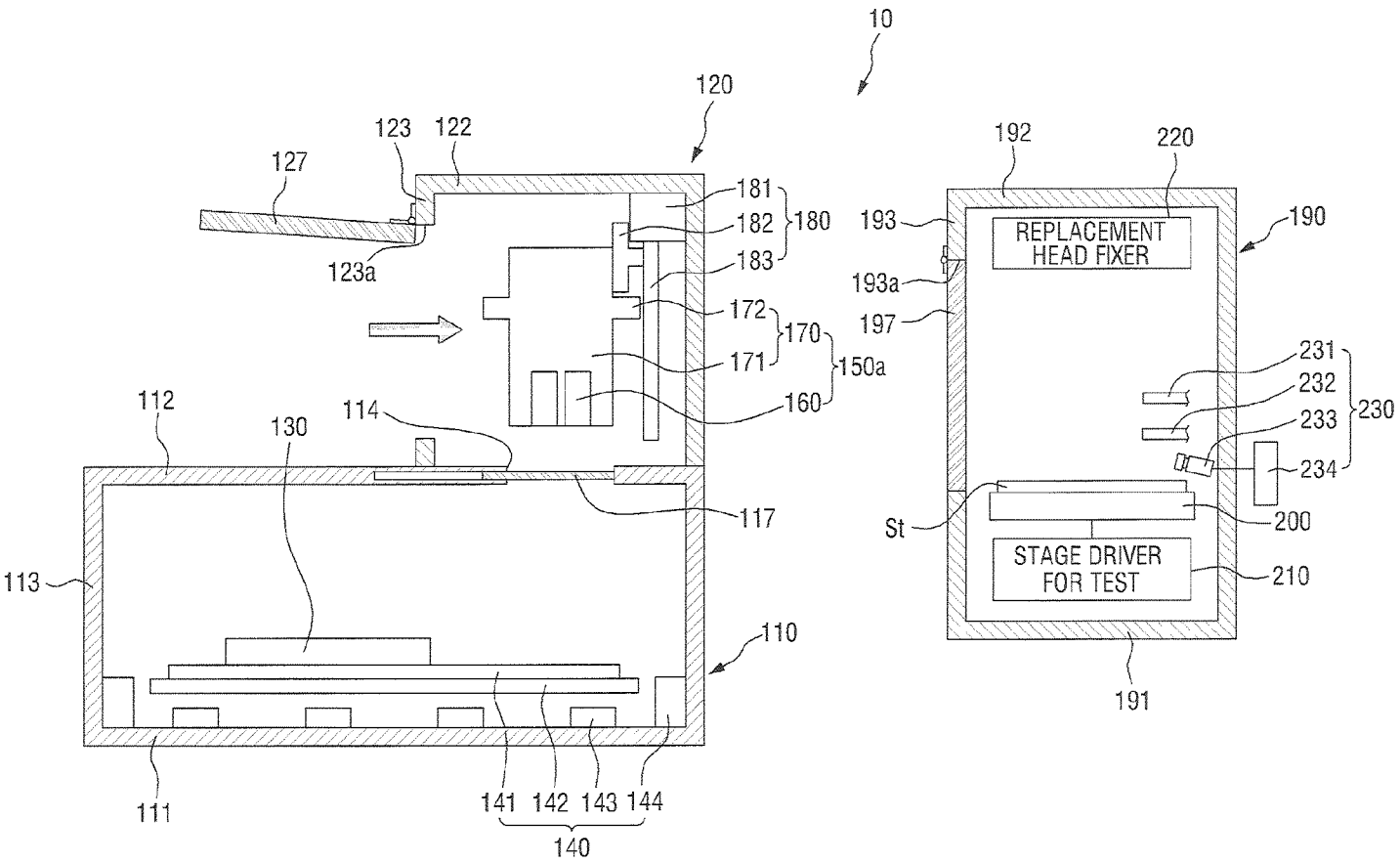

Subsequently, in reference to FIGS. 12 and 13, the third gate 197 is actuated to open the third opening 193*a* and discharge the replacement head module 150*a* from the third chamber 190 and thereafter, make the replacement head module 150*a* lead in the internal space of the second chamber 120 through the opened second opening 123*a*. In this case, the replacement head module 150*a* may lead in the internal space of the second chamber 120 and thereafter, be coupled to the head driver 180. The replacement head module 150*a* may be moved and coupled by the robot or the operator.

Figure 14:
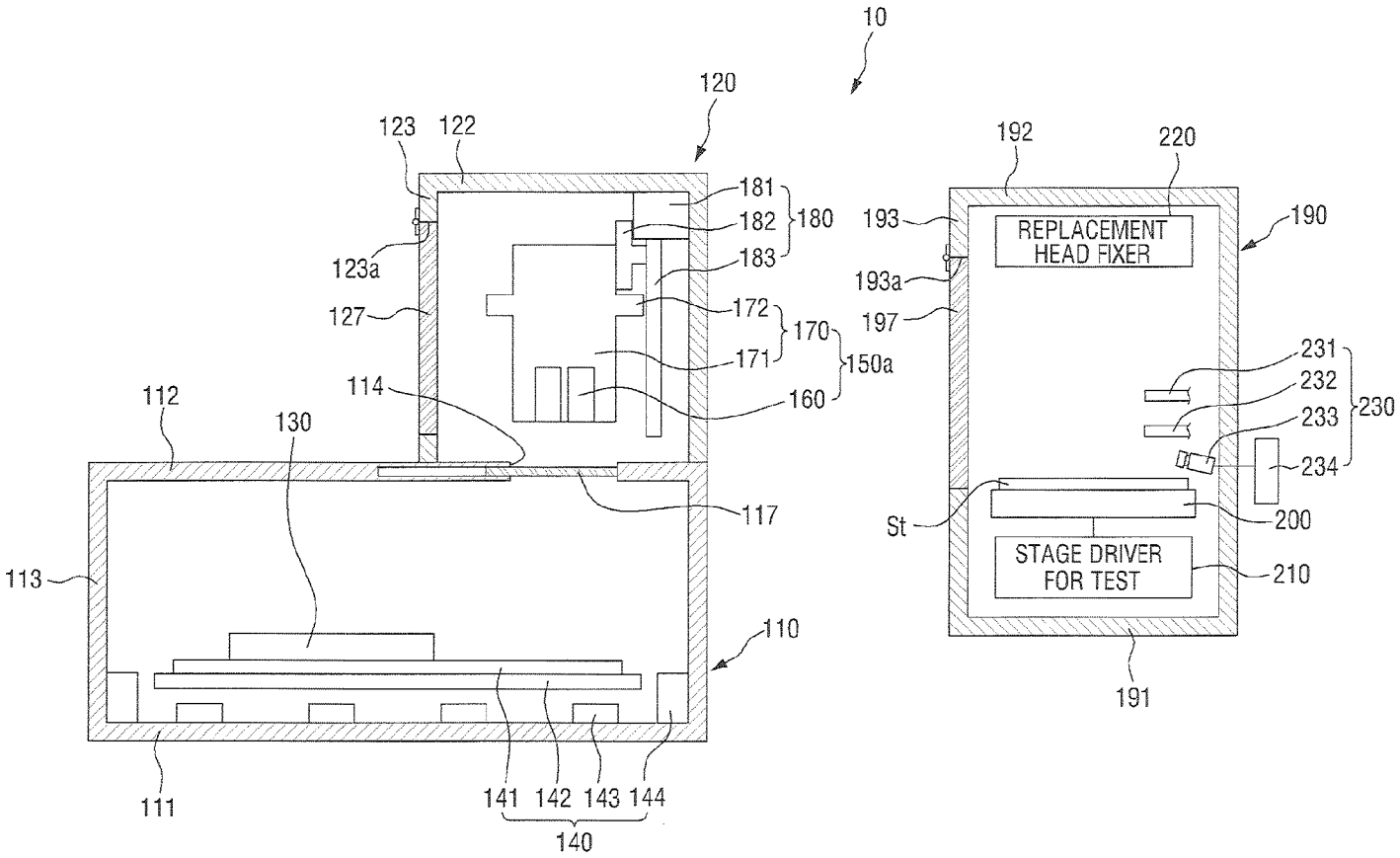

Subsequently, in reference to FIG. 14, the second gate 127 is actuated to close the second opening 123*a* and make the internal space of the second chamber 120 be in the inert gas atmosphere.

Figure 15:
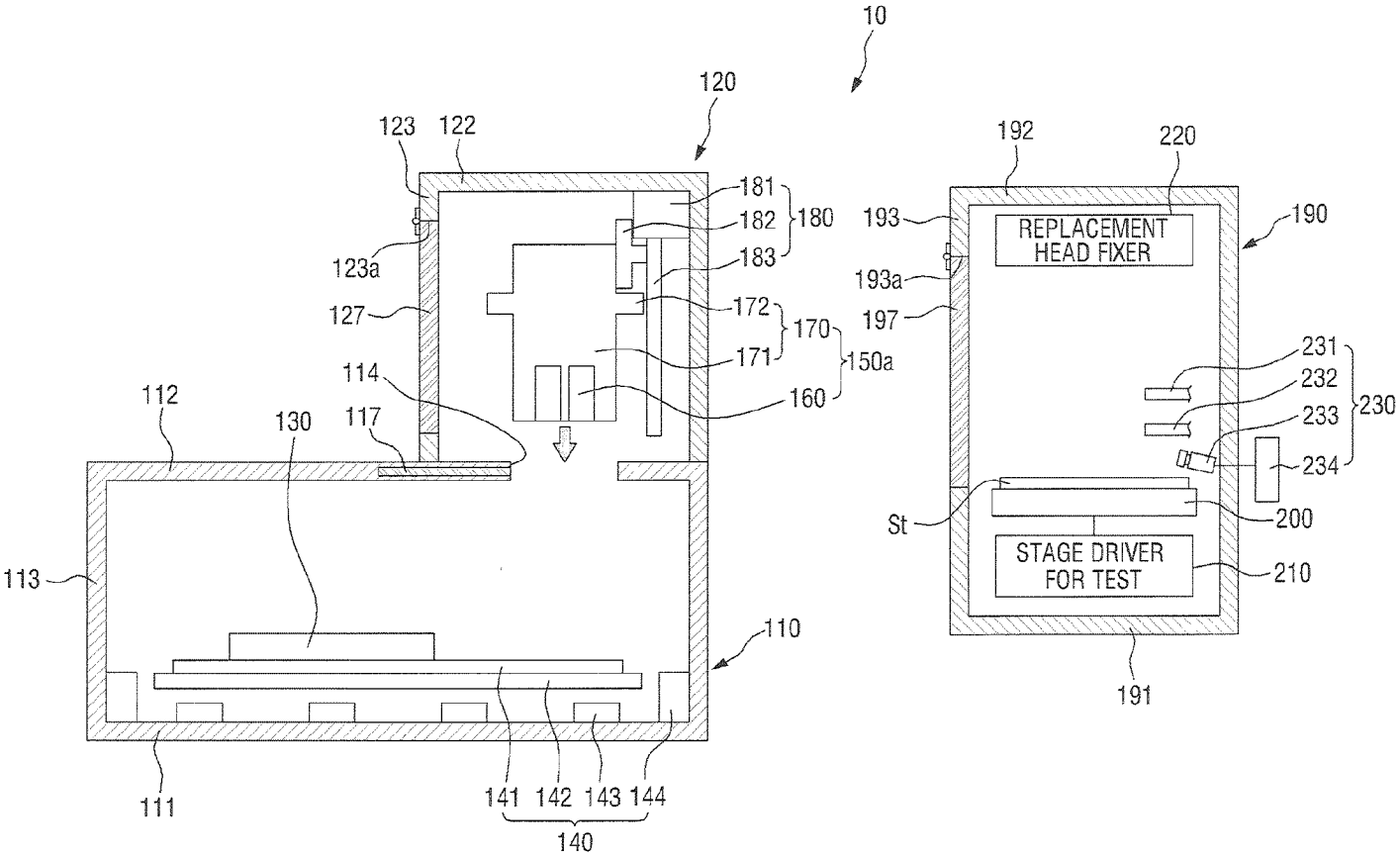
Figure 16:
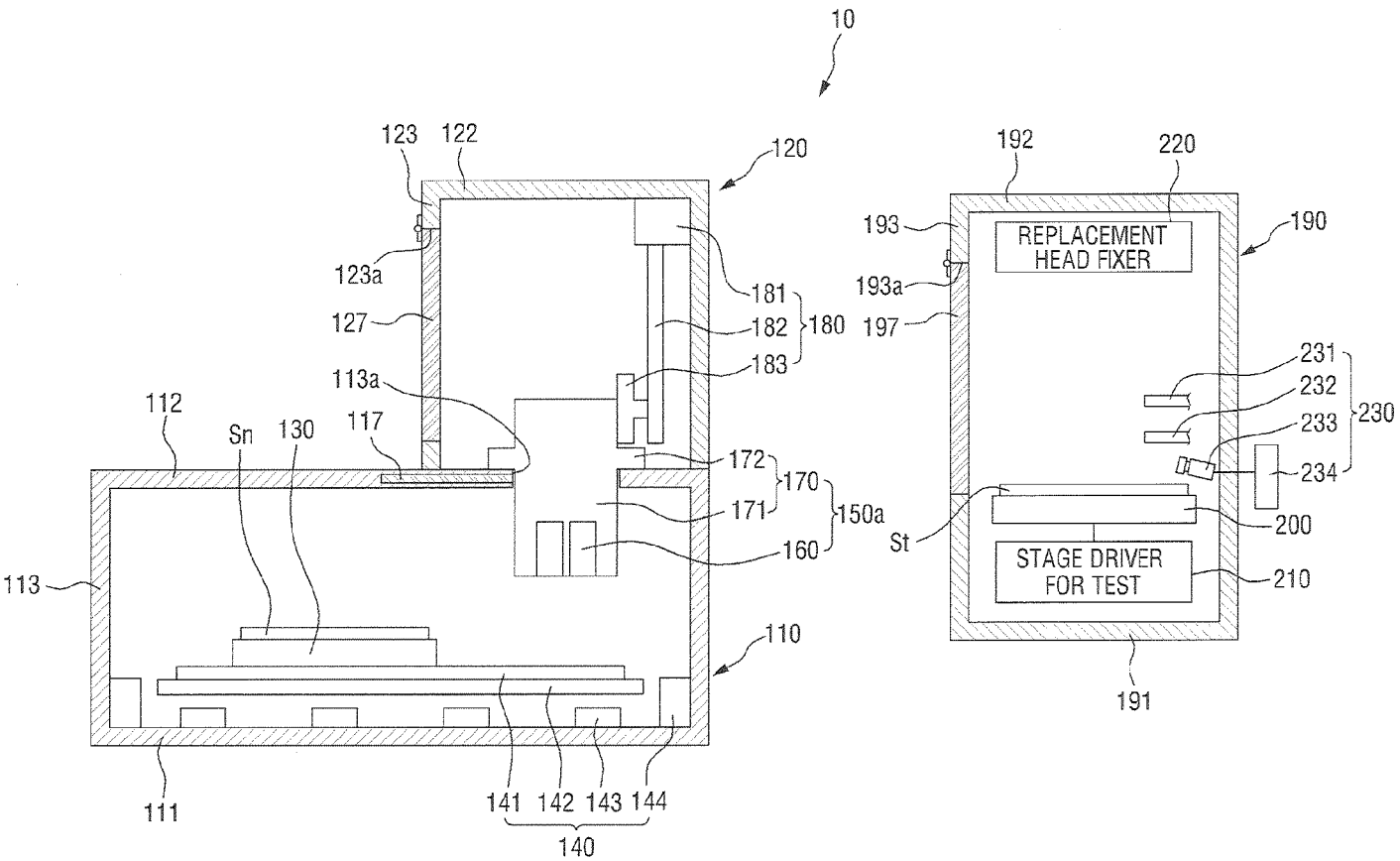

Subsequently, in reference to FIG. 15, the first gate 117 is actuated to open the first opening 114 and vertically move the replacement head module 150*a* to the internal space of the first chamber 110 from the internal space of the second chamber 120. Then, as illustrated in FIG. 16, the replacement head module 150*a* leads in the internal space of the first chamber 110 from the internal space of the second chamber 120 through the first opening 114 of the first chamber 110 to be disposed in the internal space of the first chamber 110 and while the wing part 172 of the replacement head module 150*a* is extended onto the first top wall 112 of the first chamber 110 from the lower side of the internal space of the second chamber 120, the replacement head module 150*a* is fixed. In this case, a second substrate Sn in which the ink ejection process is to be performed may lead in the internal space of the first chamber 110 like the first substrate S.

Figure 17:
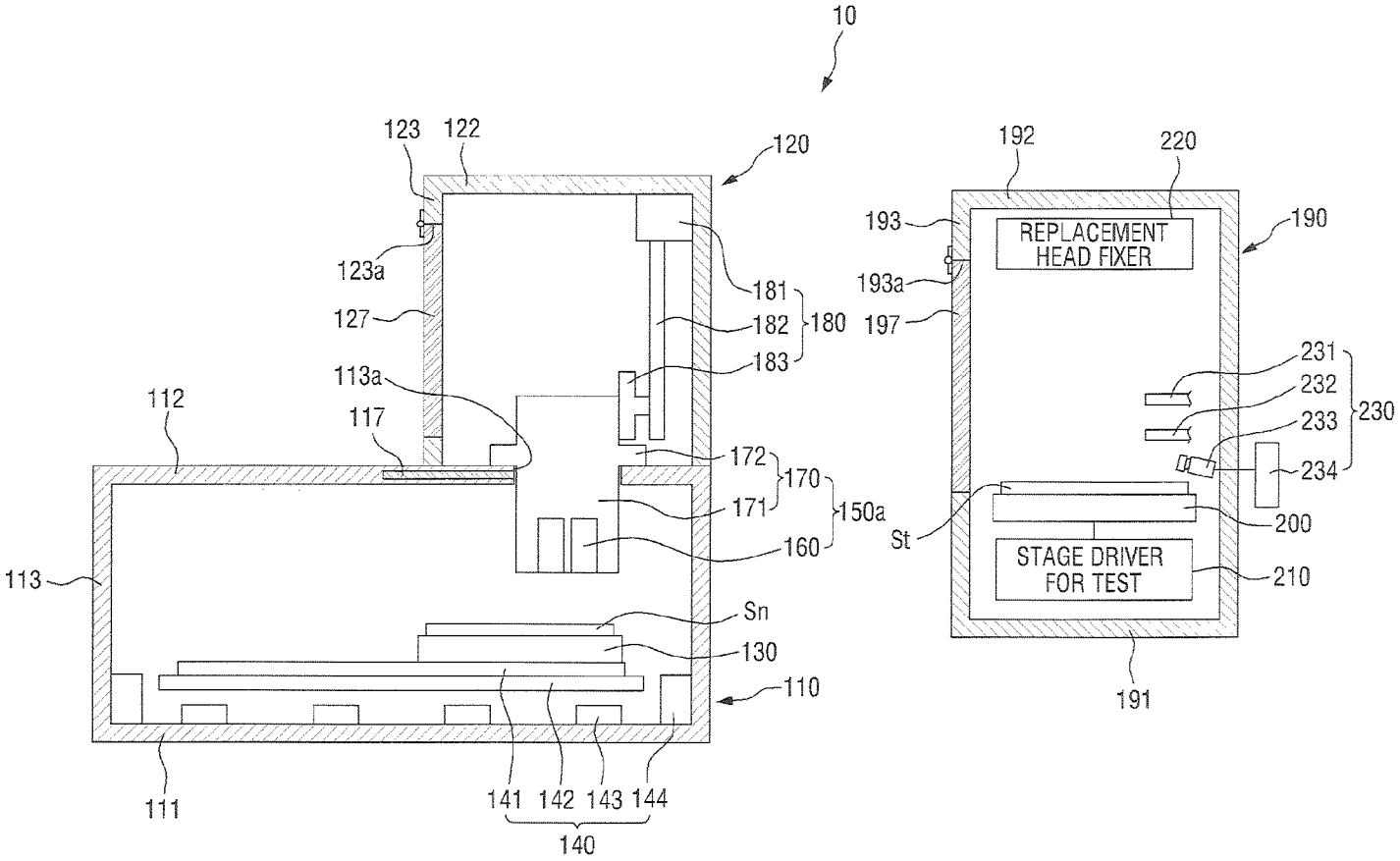

Subsequently, in reference to FIG. 17, the substrate Sn seated on the stage 130 is disposed in the lower part of the replacement head module 150*a* and while the stage 130 is moved in the state where the replacement head module 150*a* is fixed, the ink is ejected to the second substrate Sn from the plurality of heads 160 of the replacement head module 150*a*.

Next, an inkjet print apparatus 10*a* according to another embodiment of the present invention will be described.

Figure 18:
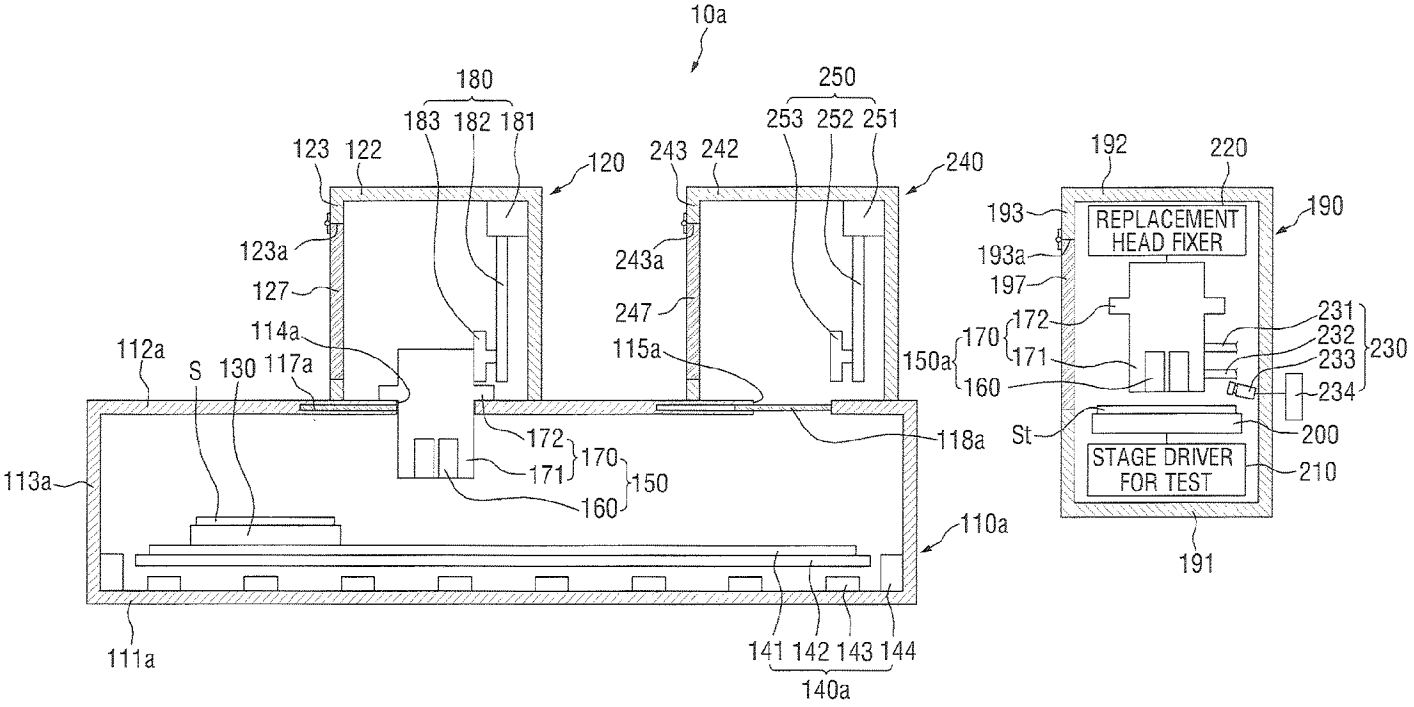
FIG. 18 is a cross-sectional view illustrating, in detail, an inkjet print apparatus according to another embodiment of the present invention.

FIG. 18 is a cross-sectional view illustrating, in detail, an inkjet print apparatus according to another embodiment of the present invention.

When the inkjet print apparatus 10*a* according to another embodiment of the present invention is compared with the inkjet print apparatus 10 of FIG. 2, these two inkjet print apparatuses are different from each other in that the first chamber 110*a* and the stage driver 140*a* and a fourth chamber 240 and a replacement head driver 250 are further included in the embodiment of FIG. 18, and these two inkjet print apparatuses are the same as each other in other components. As a result, in the inkjet print apparatus 10*a* according to another embodiment of the present invention, the first chamber 110*a*, the stage driver 140*a*, the fourth chamber 240, and the replacement head driver 250 will be primarily described.

In reference to FIG. 18, the inkjet print apparatus 10*a* according to another embodiment of the present invention includes the first chamber 110*a*, the second chamber 120, the stage 130, the stage driver 140*a*, the head module 150, the head driver 180, the third chamber 190, the test stage 200, the test stage driver 210, the replacement head module 150*a*, the replacement head fixer 220, the tester 230, the fourth chamber 240, and the replacement head driver 250. The inkjet print apparatus 10*a* may be used to form the organic light emitting layer on a substrate of the display device, for example, the organic light emitting display.

The first chamber 110*a* as the process chamber is formed to have an internal space in which the ink ejection process of ejecting the ink to the first substrate S from the plurality of heads 160 of the head module 150 is performed, and the first chamber 110*a* is similar to the first chamber 110 of FIG. 2. However, the first chamber 110*a* is formed to have an internal space larger than the internal space of the first chamber 110. That is, the first chamber 110*a* includes a first bottom wall 111*a* having a large horizontal width, a first top wall 112*a* facing the first bottom wall 111*a*, and first side walls 113*a* connecting the first bottom wall 111*a* and the first top wall 112*a*. A first opening 114*a* may be formed at a partial region of the first top wall 112*a*. The first opening 114*a* forms a passage in which the head module 150 vertically moves between the internal space of the first chamber 110 and the internal space of the second chamber 120 in order to replace the head module 150. Further, a sub opening 115*a* may be formed at another partial region of the first top wall 112*a*. The sub opening 115*a* forms a passage in which the replacement head module 150*a* input into the internal space of the first chamber 110*a* vertically moves between the internal space of the first chamber 110 and the internal space of the fourth chamber 240 in order to replace the head module 150.

The first chamber 110*a* may further include a first gate 117*a* that enables the first opening 114*a* to be opened and closed. The first gate 117*a* is actuated to open the first opening 114*a* in the ink ejection process to allow the lower part of the head module 150 to pass through the first opening 114*a* and the upper part of the head module 150 to be fixed with being extended onto the first top wall 112 at the lower side of the internal space of the second chamber 120.

The first chamber 110*a* may further include a sub gate 118*a* that enables the sub opening 115*a* to be opened and closed. The sub gate 118*a* is actuated to open the sub opening 115*a* during a replacement process of replacing the head module 150 with the head module 150*a*, thereby vertically moving the replacement head module 150*a* to the internal space of the first chamber 110 from the internal space of the fourth chamber 240 (see FIG. 20). However, the sub gate 118*a* is actuated to close the sub opening 115*a* before vertically moving the replacement head module 150*a* to the internal space of the first chamber 110 from the internal space of the fourth chamber 240.

The stage driver 140*a* is disposed below the stage 130 and configured to horizontally move the stage 130. The stage driver 140*a* may include the first linear motor 141, the second linear motor 142, the first air bearing 143, and the second air bearing 144 similarly to the stage driver 140 of FIG. 2. However, the first linear motor 141, the second linear motor 142, the first air bearing 143, and the second air bearing 144 of the stage driver 140*a* are installed so that the stage 130 horizontally moves to the lower part of the replacement head module 150*a* fixed to extend on the first top wall 112*a* through the sub opening 115*a* of the first top wall 112*a* in the first chamber 110*a* having an enlarged internal space.

The fourth chamber 240 as the replacement chamber such as the second chamber 120 is disposed to contact the top of the first chamber 110 and formed to have an internal space in which the replacement head module 150*a* leads in order to replace the head module 150. That is, the fourth chamber 240 may include a fourth top wall 242 facing the first top wall 112 of the first chamber 110*a* and fourth side walls 243 connecting a portion on the first top wall 112 of the first chamber 110*a*, which includes the sub opening 115*a* and the fourth top wall 242. A fourth opening 243*a* may be formed at any one of the fourth side walls 243. The fourth opening 243*a* forms a passage in which the replacement head module 150*a* may move in order to replace the head module 150 with the replacement head module 150*a*. As a result, the replacement head module 150*a* may move to the internal space of the second chamber 120 through the fourth opening 243*a*. Herein, the replacement head module 150*a* that moves to the internal space of the fourth chamber 240 may be a head module determined that there is no problem in performing the ink ejection process by the test for state checking in the third chamber 190.

The fourth chamber 240 may further include a fourth gate 247 that enables the fourth opening 243*a* to be opened and closed. The fourth gate 247 is actuated to open the fourth opening 247 during the replacement process, thereby moving the replacement head module 150*a* to the internal space of the fourth chamber 240. Further, the fourth gate 247 may be actuated to close the fourth opening 247 after the replacement head module 150*a* moves to the internal space of the fourth chamber 240 (see FIG. 14).

Although not illustrated, the gas supply pipe which enables the inert gas such as the nitrogen gas to be provided in order to make the internal space of the fourth chamber 240 with the inert gas atmosphere and the vent unit which enables the air to be provided in order to make the internal space of the fourth chamber 240 with the air atmosphere may be formed at one side of the fourth chamber 240. The inert gas atmosphere or the air atmosphere of the internal space of the fourth chamber 240 may be selected to make the atmospheres of the internal spaces of the first and fourth chambers 110*a* and 240 similarly match each other when the replacement head module 150 vertically moves between the internal space of the first chamber 110*a* and the internal space of the fourth chamber 240.

The replacement head driver 250 is disposed in the internal space of the fourth chamber 240 and configured to vertically move the replacement head module 250 between the internal space of the first chamber 110*a* and the internal space of the fourth chamber 240. The replacement head driver 250 may include a motor 251 generating power, a ball bearing 252 connected to the motor 251 and rotated by the power of the motor 251, and a plate 253 coupled with the replacement head module 150*a* and linearly moving by the rotation of the ball bearing 252 to vertically move the replacement head module 150*a*. Since the replacement head driver 250 is disposed in the internal space of the fourth chamber 240, the contamination of the internal space of the first chamber 110*a*, which is caused due to the particles generated by the contact of the instruments of the replacement head driver 250 may be minimized when the replacement head module 150*a* vertically moves during the replacement process.

The inkjet print apparatus 10*a* according to another embodiment of the present invention includes the third chamber 190 disposed outside the first chamber 110*a* and the second chamber 120 and providing the space for performing the test to check the state of the replacement head module 150*a* to inspect the replacement head module 150*a* in advance, which may be input into the internal space of the first chamber 110*a*. Accordingly, a required time is reduced as a state of the replacement head module is tested while the replacement head module is input into the internal space of the first chamber when the existing head module is replaced with the replacement head module in the related art, and as a result, a total process time of an ink ejection process using an inkjet print apparatus can be reduced.

The inkjet print apparatus 10*a* according to another embodiment of the present invention includes the fourth chamber 240 that is disposed to contact the top of the first chamber 110*a* and allows the replacement head module 150*a* to be input into the internal space of the first chamber 110*a* to dispose the replacement head module 150*a* at one side of the first chamber 110*a* in advance. Accordingly, after the head module 150 is discharged through the second chamber 120 at the time of replacing the head module 150 with the replacement head module 150*a* and the second substrate seated on the stage 130 horizontally moves to the lower part of the replacement head module 150*a*, the ink ejection process to the second substrate (Sn of FIG. 22) is performed to further reduce the total process time of the ink ejection process using the inkjet print apparatus.

The inkjet print apparatus 10*a* according to another embodiment of the present invention includes the replacement head driver 250 disposed in the internal space of the fourth chamber 240 positioned above the first chamber 110*a* to eject ink to the second substrate (Sn of FIG. 22) from the plurality of heads 60 by horizontally moving the stage 130 while fixing the replacement head module 150*a* in the ink ejection process and actuate the replacement head driver 250 that vertically moves the replacement head module 150*a* in the fourth chamber 240 in the replacement process of the head module 150. Accordingly, the replacement head driver 250 is not actuated in the ink ejection process to prevent the particles from being generated by the contact of the instruments and the replacement head driver 250 is actuated in the replacement process of the head module 150 to minimize contamination of the internal space of the first chamber 110*a* due to the particles which lead in the internal space of the first chamber 110*a* even though the particles are generated in the internal space of the fourth chamber 240 by the contact of the instruments.

Next, an inkjet print method using the inkjet print apparatus 10*a* according to the embodiment of the present invention will be described.

FIGS. 19 through 23 are diagrams for illustrating an inkjet print method using the inkjet print apparatus of FIG. 18.

Figure 19:
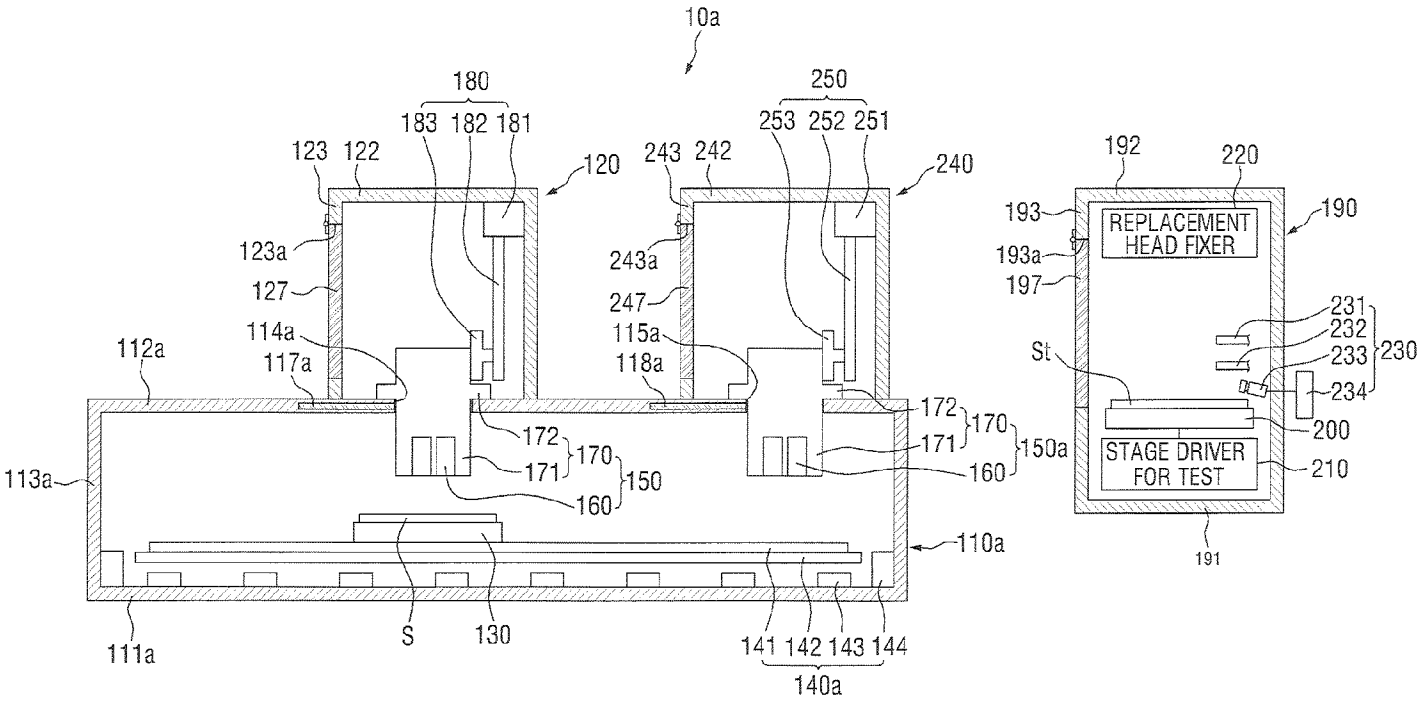
FIGS. 19 through 22 are diagrams for illustrating an inkjet print method using the inkjet print apparatus of FIG. 18.

In reference to FIG. 19, the first substrate S seated on the stage 130 disposed in the internal space of the first chamber 110*a* is disposed in the lower part of the head module 150 disposed in the internal space of the first chamber 110*a*. In this case, the internal space of the first chamber 110*a* may be the inert gas atmosphere charged with the inert gas. Herein, the head module 150 leads in the internal space of the first chamber 110 from the internal space of the second chamber 120 through the first opening 114*a* of the first chamber 110*a* to be disposed in the internal space of the first chamber 110 and while the wing part 172 of the head module 150 is extended onto the top wall 112 of the first chamber 110 from the lower side of the internal space of the second chamber 120, the head module 150 is fixed.

By horizontally moving the stage 130 in the first direction (X of FIG. 8) and the second direction (Y of FIG. 8) while the head module 150 is fixed, the ink is ejected to the first substrate S from the plurality of heads 160 (ink ejection process). Meanwhile, during the ink ejection process, the replacement head module 150*a* of which the test for checking the state may be disposed in the internal space of the first chamber 110*a*. The replacement head module 150*a* is discharged from the third chamber 190 and thereafter, leads in the internal space of the fourth chamber 240 and vertically moves to pass through the sub opening 115*a* of the first chamber 110*a* by the replacement head driver 250 to be disposed with being extended on the first top wall 112*a* of the first chamber 110*a*. Since the test of the replacement head module 150*a* has been described above in detail, a duplicated description will be omitted.

Figure 20:
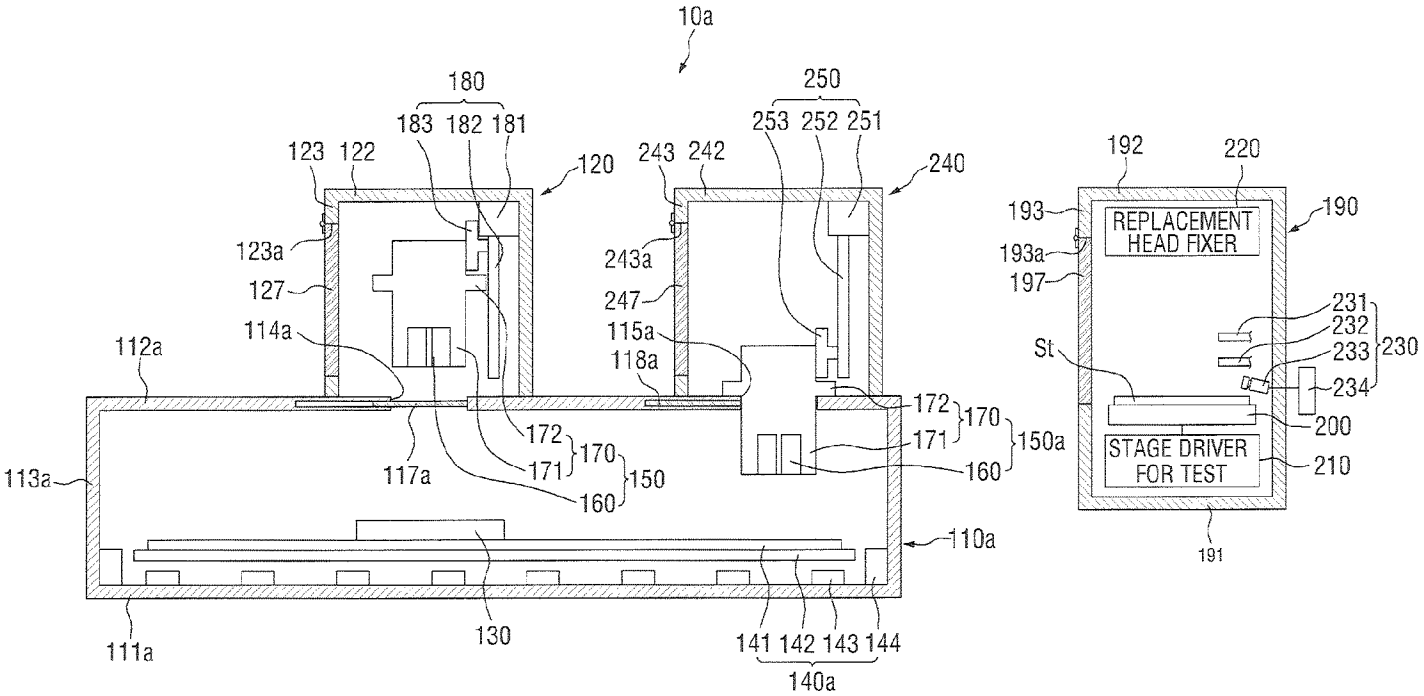

Subsequently, in reference to FIG. 20, when replacement of the head module 150 is required, the head module 150 vertically moves to the internal space of the second chamber 120 from the internal space of the first chamber 110. In this case, the internal space of the second chamber 120 may be in the inert gas atmosphere similarly to the internal space of the first chamber 110. Further, the first substrate S may be discharged from the first chamber 110. The head module 150 may vertically move by actuating the head driver 180.

The head module 150 is disposed in the internal space of the second chamber 120 and thereafter, actuates the first gate 117*a* to close the first opening 114*a*. Thereafter, the internal space of the second chamber 120 is made to be in the stand-by state by using a vent unit (not illustrated).

Figure 21:
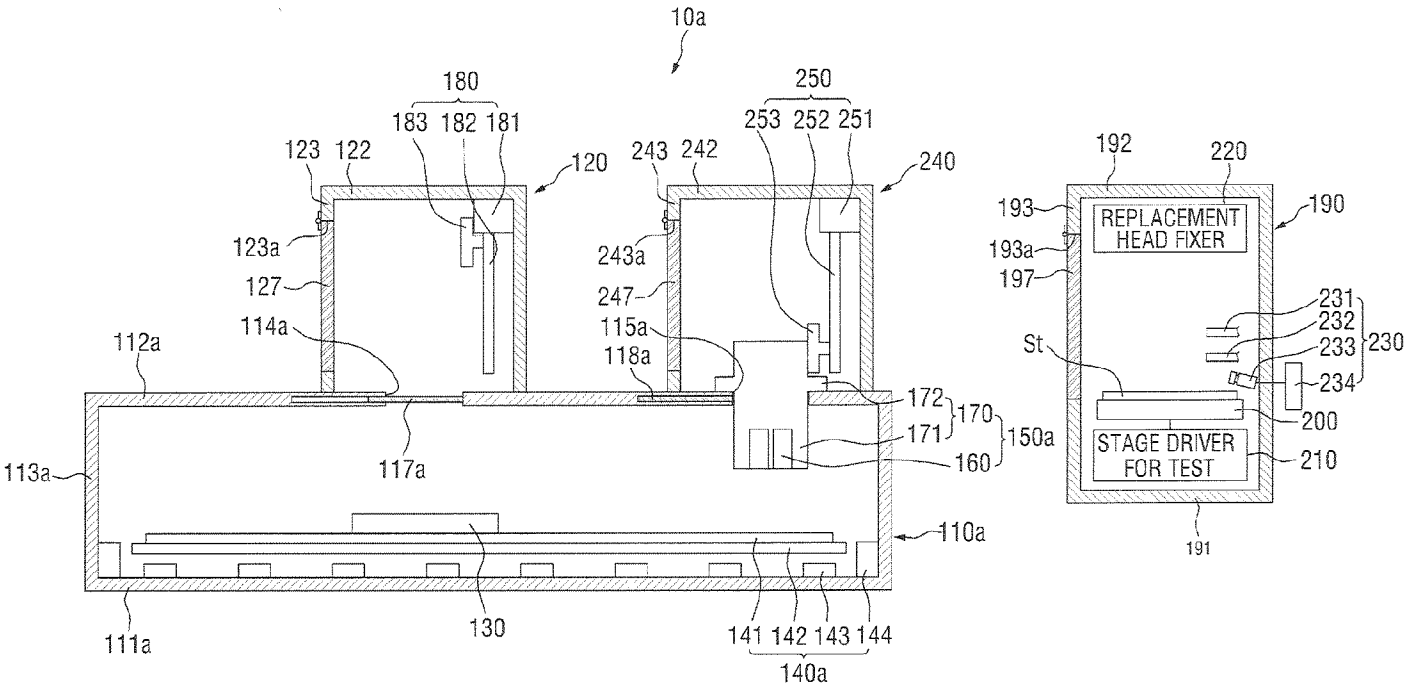

Subsequently, in reference to FIG. 21, the second gate 127 is actuated to open the second opening 123*a* and discharge the head module 150 from the second chamber 120 and thereafter, the second gate 127 is actuated to close the second opening 123*a*.

Figure 22:
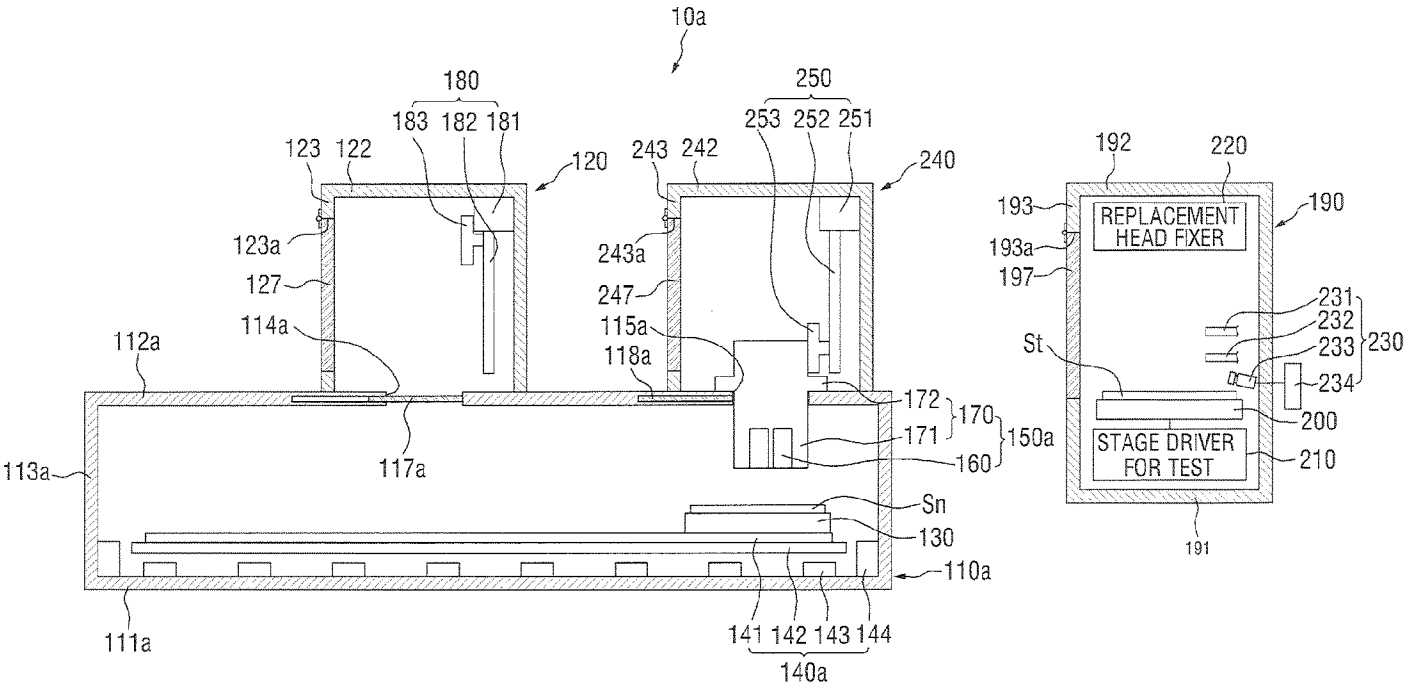

Subsequently, in reference to FIG. 22, the second substrate Sn in which the ink ejection process is to be performed is seated on the stage 130 like the first substrate (S of FIG. 19) and disposed in the lower part of the replacement head module 150*a* and thereafter, while the stage 130 is moved in the state where the replacement head module 150*a* is fixed, the ink is ejected to the second substrate Sn from the plurality of heads 160 of the replacement head module 150*a*.

The foregoing is illustrative of the present invention and is not to be construed as limiting thereof. Although a few embodiments of the present invention have been described, those skilled in the art will readily appreciate that many modifications are possible in the embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. An inkjet print method, comprising:

placing a first substrate seated on a stage in an internal space of a first chamber below a head module that vertically moves between an internal space of a second chamber disposed to contact a top of the first chamber and the internal space of the first chamber;

ejecting ink to the first substrate from a plurality of heads of the head module by horizontally moving the stage while fixing the head module to the first chamber;

vertically moving the head module to the internal space of the second chamber from the internal space of the first chamber when the head module is replaced with a replacement head module; and performing a test for checking a state of the replacement head module in a third chamber disposed outside the first chamber and the second chamber.

2. The inkjet print method of claim 1, further comprising:

discharging the head module to an exterior of the second chamber after the vertically moving of the head module and making the replacement head module lead in the internal space of the second chamber to vertically move the replacement head module to the internal space of the first chamber from the internal space of the second chamber.

3. The inkjet print method of claim 1, wherein in the vertically moving of the head module, the internal space of the first chamber and the internal space of the second chamber have the same atmosphere.

4. The inkjet print method of claim 1, wherein the vertically moving of the head module is performed by a head driver disposed in the internal space of the second chamber.

5. The inkjet print method of claim 1, wherein the replacement head module is configured similarly to the head module.

6. The inkjet print method of claim 1, wherein the vertically moving of the head module is performed by a head driver disposed in the internal space of the second chamber, and wherein the first chamber includes a first bottom wall, a first top wall facing the first bottom wall and having a first opening that forms a passage in which the head module vertically moves, first side walls connecting the first bottom wall and the first top wall, and a first gate installed on the first top wall and actuated to open and close the first opening.

7. The inkjet print method of claim 6, wherein the head module includes a plurality of heads including nozzles ejecting ink and a case including a body part covering tops and sides of the plurality of heads and a wing part that protrudes from an outer periphery of the body part.

8. The inkjet print method of claim 7, wherein the wing part extends on the top wall of the first chamber at the lower side of the internal space of the second chamber and a width of a part of the case at which the wing part is positioned is larger than that of the first opening.

9. The inkjet print method of claim 6, wherein the second chamber includes a second top wall facing the first top wall, second side walls connecting a part on the first top wall, which includes the first opening and the second top wall and having a second opening that forms a passage through which the head module or the replacement head module passes on any one of the second side walls, and a second gate installed on any one of the second side walls and actuated to open and close the second opening.

10. The inkjet print method of claim 9, wherein the head driver includes a motor installed on another of the second side walls, a ball bearing connected to the motor, and a plate coupled with the head module and vertically moving in connection with the ball bearing.

11. The inkjet print method of claim 1, wherein the third chamber includes a third bottom wall, a third top wall facing the third bottom wall, third side walls connecting the third bottom wall and the third top wall and having a third opening that forms the passage through which the replacement head module passes on any one of the third side walls, and a third gate actuated to open and close the third opening.

12. The inkjet print method of claim 1, wherein the stage is horizontally moved by a stage driver disposed below the stage in the internal space of the first chamber, and the stage driver includes a first linear motor supporting the stage and moving the stage in a first direction, a second linear motor disposed below the first linear motor and moving the stage in a second direction vertical to the first direction, a first air bearing disposed on the first bottom wall of the first chamber, and a second air bearing disposed on the first side walls of the first chamber.

13. The inkjet print method of claim 1, further comprising:

discharging the replacement head module from the third chamber and vertically moving the replacement head module to the internal space of the first chamber from an internal space of a fourth chamber disposed to contact the top of the first chamber, wherein the vertically moving of the head module is performed by a head driver disposed in the internal space of the second chamber, and wherein the first chamber includes a first bottom wall, a first top wall facing the first bottom wall and having a first opening that forms a passage in which the head module vertically moves, first side walls connecting the first bottom wall and the first top wall, and a first gate installed on the first top wall and actuated to open and close the first opening.

14. The inkjet print method of claim 13, wherein after the vertically moving of the head module, the replacement head module is fixed to the internal space of the first chamber when the head module is discharged to an exterior of the second chamber.

15. The inkjet print method of claim 13, wherein the replacement head module is vertically moved by a replacement head driver disposed in the internal space of the fourth chamber.

16. The inkjet print method of claim 15, wherein the first chamber further includes a sub opening formed on the first top wall and forming a passage in which the replacement head module vertically moves and a sub gate installed on the first top wall and actuated to open and the close the sub opening, and the fourth chamber includes a fourth top wall facing the first top wall, fourth side walls connecting a part on the fourth top wall, which includes the sub opening and the fourth top wall and having a fourth opening forming the passage through which the replacement head module passes on any one of the fourth side walls, and a fourth gate installed on any one of the fourth side walls and actuated to operate and close the fourth opening.

17. The inkjet print method of claim 16, wherein the replacement head driver includes a motor installed on another of the fourth side walls, a ball bearing connected to the motor, and a plate coupled with the replacement head module and vertically moving in connection with the ball bearing.

18. The inkjet print method of claim 13, wherein in the vertically moving of the replacement head module, the internal space of the fourth chamber and the internal space of the first chamber have the same atmosphere.

19. The inkjet print method of claim 1, wherein the test of the replacement head module is a test for determining whether the replacement head module is a head module that meets an ink ejection condition, and the ink ejection condition includes a condition in which ink is ejected from the head of the replacement head module and an ejection amount of the ink ejected from the head of the replacement head module is the same as a reference ejection amount for a predetermined time.

20. The inkjet print method of claim 19, wherein the test of the replacement head module is performed by a tester disposed in the internal space of or outside the third chamber, and the tester includes an electric signal line connected to the plurality of heads, an ink supply pipe connected to the plurality of heads, a camera photographing ink ejected to a test substrate from the plurality of heads of the replacement head module, and a test controller receiving photographed data from the camera.

* * * * *